US011450500B1

(12) United States Patent
Albrecht

(10) Patent No.: US 11,450,500 B1
(45) Date of Patent: Sep. 20, 2022

(54) SHOCK RESISTANT MOUNTING STRUCTURES FOR FUZE SYSTEMS

(71) Applicant: The United States of America, as represented by the Secretary of the Navy, Arlington, VA (US)

(72) Inventor: Nicholas H. Albrecht, Ridgecrest, CA (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 17/406,450

(22) Filed: Aug. 19, 2021

Related U.S. Application Data

(63) Continuation-in-part of application No. 16/737,214, filed on Jan. 8, 2020, now Pat. No. 11,131,533.

(51) Int. Cl.

| | |
|---|---|
| ***F42C 19/04*** | (2006.01) |
| ***H01H 85/175*** | (2006.01) |
| ***H01H 85/20*** | (2006.01) |
| ***H01H 85/00*** | (2006.01) |
| ***F42B 39/24*** | (2006.01) |
| ***F42C 19/02*** | (2006.01) |

(52) U.S. Cl.
CPC ..... *H01H 85/175* (2013.01); *F42B 39/24* (2013.01); *F42C 19/02* (2013.01); *F42C 19/04* (2013.01); *H01H 85/0017* (2013.01); *H01H 85/2045* (2013.01)

(58) Field of Classification Search
CPC ..... F42C 19/02; F42C 19/04; F42B 39/24; H01H 85/0017; H01H 85/2045; H01H 85/175
USPC ..... 102/331, 332, 333, 202, 275.9, 275.11, 102/275.12
See application file for complete search history.

(56) References Cited

U.S. PATENT DOCUMENTS 2,388,310 A * 11/1945 Curtiss ..... F42D 1/043 102/275.12
3,058,419 A * 10/1962 O'Brien ..... F42B 3/26 102/331
5,133,258 A * 7/1992 Rock ..... F42B 39/14 89/34

(Continued)

OTHER PUBLICATIONS

Google Search for "Shock Resistant Washer".

*Primary Examiner* — Joshua E Freeman
(74) *Attorney, Agent, or Firm* — Naval Air Warfare Center Weapons Division; Jimmy M. Sauz

(57) ABSTRACT

Shock resistant mounting structures for fuze systems. The shock resistant mounting structures may comprise: a shock resistant fuze cap and a shock resistant collar. The shock resistant fuze cap may comprise a circular cap housing and a plurality of cripple studs disposed within the circular cap housing. The circular cap housing may be adapted to engage an upper portion of a fuze and may be adapted to snugly fit within a fuze well. The shock resistant collar may comprise a ring-shaped housing and one or more cripple studs radially disposed within the ring-shaped housing. The ring-shaped housing may have a center opening adapted to engage a fuze body. When installed, the shock resistant fuze cap and shock resistant collar may be disposed within the fuze well and may minimize, prevent, or divert shock loading energy from entering a fuze.

20 Claims, 15 Drawing Sheets

(56) References Cited

U.S. PATENT DOCUMENTS

| | | | | |
|---|---|---|---|---|
| 5,327,835 | A * | 7/1994 | Adams | F42D 1/043 102/275.12 |
| 5,492,366 | A * | 2/1996 | Osborne | B60R 21/2644 102/275.12 |
| 5,799,974 | A * | 9/1998 | Honda | B60R 21/203 280/739 |
| 6,283,505 | B1 * | 9/2001 | Saso | B60R 21/2644 280/736 |
| 7,971,533 | B1 * | 7/2011 | Berlin | F42C 19/02 102/275.9 |
| 2012/0192748 | A1 * | 8/2012 | Scheid | F42B 3/26 403/221 |
| 2016/0169640 | A1 * | 6/2016 | Schwuchow | B23P 19/00 102/275.12 |
| 2022/0145918 | A1 * | 5/2022 | Arndt | F16F 1/3835 |

* cited by examiner

SHOCK RESISTANT MOUNTING STRUCTURES FOR FUZE SYSTEMS

CROSS-REFERENCE TO RELATED APPLICATIONS

This application is a continuation-in-part patent application of the commonly owned, U.S. non-provisional patent application Ser. No. 16/737,214, titled "Shock Resistant Mounting Structures for Fuze Systems," filed on Jan. 8, 2020 by inventor Nicholas H. Albrecht, the contents of which are hereby expressly incorporated herein by reference in its entirety and to which priority is claimed.

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

FIELD OF USE

The present disclosure relates generally to shock resistant structures configured to absorb, minimize, or divert shock energy for fuze survivability.

BACKGROUND

When performing shock testing or within a tactical environment, a device may be subject to sudden and extreme amounts of acceleration or deceleration. This helps determine to what degree items can physically withstand relatively infrequent forces or mechanical shocks and vibrations. During pyroshock testing or warhead penetration testing, for example, extreme shock waves may travel through various structures and advance into the housings of the electronics (e.g., fuze). These shock waves may mechanically break and damage the sensitive electronics, often impairing or disabling the warhead and disrupting mission critical events. In this regard, there is a need for a device, structure, or mechanism that absorbs, diverts, prevents, or minimizes extreme shock loading energy traveling towards critical electronic components.

SUMMARY OF ILLUSTRATIVE EMBODIMENTS

To minimize the limitations in the related art and other limitations that will become apparent upon reading and understanding the present specification, the following discloses embodiments of new and useful shock resistant mounting structures for fuze systems.

One embodiment may be a shock resistant collar, comprising: a ring-shaped housing having a center opening adapted to engage a fuze body, such that the ring-shaped housing may surround and snugly fit at least a portion of the fuze body; and one or more cripple studs radially disposed within the ring-shaped housing; wherein the one or more cripple studs may extend between opposing sides of the ring-shaped housing. The ring-shaped housing may be filled with a urethane polymer. Each of the one or more cripple studs may have a cross section substantially shaped as a cross with a web portion having a maximum thickness of 0.25 inches. Each of the one or more cripple studs may be oriented in spaced parallel relation to each other. The ring-shaped housing and the one or more cripple studs may be constructed of a metal. The ring-shaped housing and the one or more cripple studs may form a single unitary piece.

Another embodiment may be a shock resistant fuze cap, comprising: a circular cap housing having a receptacle configured to engage a flange end of a fuze, the circular cap housing being adapted to snugly fit within a fuze well, such that the circular cap housing may be disposed between the flange end of the fuze and the fuze well; and a plurality of cripple studs disposed within the circular cap housing; wherein the plurality of cripple studs may extend between at least one or more opposing sides of the circular cap housing. The circular cap housing may be filled with a urethane polymer. Each of the plurality of cripple studs may have web portions having a maximum thickness than 0.25 inches. The plurality of cripple studs may be oriented in spaced parallel relation to each other. The circular cap housing and the plurality of cripple studs may be constructed of a metal. The circular cap housing and the plurality of cripple studs may form a single unitary piece.

Another embodiment may be a shock resistant fuze cap and shock resistant collar combination, comprising: a shock resistant fuze cap and a shock resistant collar. The shock resistant fuze cap may comprise: a circular cap housing having a receptacle configured to engage a flange end of a fuze, the circular cap housing being adapted to snugly fit within a fuze well, such that the circular cap housing may be disposed between the flange end of the fuze and the fuze well; and a plurality of first cripple studs disposed within the circular cap housing. The shock resistant collar may comprise: a ring-shaped housing having a center opening adapted to engage a fuze body, the ring-shaped housing having an outer diameter less than a diameter of the receptacle of the circular cap housing, such that when the fuze body is snugly fit within the center opening of the ring-shaped housing, the ring-shaped housing may fit within the receptacle of the circular cap housing, the fuze well, and the flange end of the fuze; and one or more second cripple studs radially disposed within the ring-shaped housing. The flange end of the fuze may be disposed between the shock resistant fuze cap and the shock resistant collar when the shock resistant collar and the shock resistant fuze cap are engaged with the flange end of the fuze and installed within the fuze well. The circular cap housing may be filled with a urethane polymer. The ring-shaped housing may be filled with a urethane polymer. The plurality of first cripple studs may extend between opposing sides within the circular cap housing and may be oriented in spaced parallel relation to each other. Each of the plurality of first cripple studs may extend between opposing sides of the circular cap housing and may be oriented in a direction towards the fuze. Each of the one or more second cripple studs may have a cross section substantially shaped as a cross and may extend within opposing sides of the collar housing. The shock resistant fuze cap and the shock resistant collar may be constructed of a metal. The shock resistant fuze cap and shock resistant collar combination may further comprise a retaining ring adapted to snugly fit within the fuze well when the shock resistant fuze cap, the shock resistant collar, and the fuze are installed within the fuze well. The circular cap housing and the plurality of first cripple studs may form a single unitary piece. The ring-shaped housing and the one or more second cripple studs may form a single unitary piece.

Another embodiment may be a shock resistant collar, comprising: a ring-shaped housing having an annular space defined by: an outer cylindrical sidewall; an inner cylindrical sidewall concentrically disposed within the outer cylindrical sidewall and defining a center opening of the ring-shaped housing, the center opening being adapted to snugly insert a fuze body of a fuze; a bottom portion, generally ring-shaped, and having an inner circumference adjoining a bottom end of the inner cylindrical sidewall and an outer circumference adjoining a bottom end of the outer cylindrical sidewall; and a top portion, generally ring-shaped, and having an inner circumference adjoining a top end of the first inner cylindrical sidewall and an outer circumference adjoining a top end of the outer cylindrical sidewall; and one or more cripple studs located within the annular space of the ring-shaped housing and radially disposed around the inner cylindrical sidewall, wherein each of the one or more cripple studs may comprise: a vertical web portion having a bottom end orthogonally adjoining the bottom portion and a top end orthogonally adjoining the top portion; and a horizontal web portion having a first end orthogonally adjoining the inner cylindrical sidewall and a second end orthogonally adjoining the outer cylindrical sidewall; wherein mid-sections of the vertical web portion and the horizontal web portion may adjoin together, such that each of the one or more cripple studs may be substantially cross-shaped. The ring-shaped housing and the one or more cripple studs may be constructed of a metal; wherein the vertical web portions and the horizontal web portions of the one or more cripple studs may have a maximum thickness of 0.25 inches, such that the vertical web portions and the horizontal web portions may be semi-rigid. The ring-shaped housing may be filled with a urethane polymer. The one or more cripple studs may be oriented in spaced parallel relation to each other. The ring-shaped housing and the one or more cripple studs may form a single unitary piece. The ring-shaped housing may be generally circular.

Another embodiment may be a shock resistant fuze cap, comprising: a circular cap housing defined by: an outer cylindrical sidewall adapted to snugly fit within a fuzewell; a first inner cylindrical sidewall concentrically disposed within a bottom end of the outer cylindrical sidewall; a bottom portion, generally ring-shaped, and having an inner circumference adjoining a bottom end of the first inner cylindrical sidewall and an outer circumference adjoining the bottom end of the outer cylindrical sidewall, thereby forming a first annular space therein; a second inner cylindrical sidewall having a diameter less than the first inner cylindrical sidewall and concentrically disposed within a top end of the outer cylindrical sidewall, wherein the second inner cylindrical sidewall defines a center opening of the circular cap housing and is adapted to snugly engage an upper portion of the fuze; an intermediate portion, generally disc-shaped, and having an inner circumference adjoining a bottom end of the second inner cylindrical sidewall and an outer circumference adjoining a top end of the first inner cylindrical sidewall; and a top portion, generally disc-shaped, and having an outer circumference adjoining the top end of the outer cylindrical sidewall and an inner circumference adjoining a top end of the second inner cylindrical sidewall, such that the top portion, the second inner cylindrical sidewall, and the intermediate portion may form a second annular space therein; wherein the first inner cylindrical sidewall and the intermediate portion may form a receptacle configured to fit a flange end of a fuze, such that the circular cap housing may be adapted to be disposed between the flange end of the fuze and a fuze well; and wherein the circular cap housing may include an interior space defined by the first and second annular spaces; and a plurality of cripple studs disposed within the interior space of the circular cap housing and including: one or more first cripple studs, each comprising: a first web portion located within the first annular space and having a first end orthogonally adjoining the outer cylindrical sidewall; and a second web portion located with the first annular space and having a first end orthogonally adjoining the first inner cylindrical sidewall; wherein second ends of the first and second web portions of the one or more first cripple studs may adjoin and partially overlap each other to form one or more first single steps; one or more second cripple studs, each comprising: a first web portion disposed substantially between the first and second annular spaces and having a first end adjoining the outer cylindrical sidewall; and a second web portion located substantially between the first and second annular spaces and having a first end adjoining the top end of the first inner cylindrical sidewall and the outer circumference of the intermediate portion; wherein second ends of the first and second web portions of the one or more second cripple studs may adjoin and partially overlap each other to form one or more second single steps; and one or more third cripple studs, each comprising: a first web portion located within the second annular space and having a first end orthogonally adjoining the top portion; a second web portion located within the second annular space and having a first end orthogonally adjoining the intermediate portion; and a third web portion extending to and orthogonally adjoining second ends of the first and second web portions of the one or more third cripple studs to form one or more third single steps. The circular cap housing and the plurality of cripple studs may be constructed of a metal; and wherein the first, second, and third web portions of the plurality of cripple studs may have a maximum thickness of 0.25 inches, such that the plurality of cripple studs may be semi-rigid. The circular cap housing may be filled with a urethane polymer. The circular cap housing and the plurality of cripple studs may form a single unitary piece.

Another embodiment may be a shock resistant fuze cap and collar combination, comprising: a circular cap housing defined by: a first outer cylindrical sidewall adapted to snugly fit within a fuzewell; a first inner cylindrical sidewall concentrically disposed within a bottom end of the first outer cylindrical sidewall; a first bottom portion, generally ring-shaped, and having an inner circumference adjoining a bottom end of the first inner cylindrical sidewall and an outer circumference adjoining the bottom end of the first outer cylindrical sidewall, thereby forming a first annular space therein; a second inner cylindrical sidewall having a diameter less than the first inner cylindrical sidewall and concentrically disposed within a top end of the first outer cylindrical sidewall, wherein the second inner cylindrical sidewall defines a center opening of the circular cap housing and is adapted to snugly engage a portion of a fuze; an intermediate portion, generally disc-shaped, and having an inner circumference adjoining a bottom end of the second inner cylindrical sidewall and an outer circumference adjoining a top end of the first inner cylindrical sidewall; and a first top portion, generally disc-shaped, and having an outer circumference adjoining the top end of the outer cylindrical sidewall and an inner circumference adjoining a top end of the second inner cylindrical sidewall, such that the first top portion, the second inner cylindrical sidewall, and the intermediate portion may form a second annular space therein; wherein the first inner cylindrical sidewall and the intermediate portion may form a receptacle configured to fit a flange end of a fuze, such that the circular cap housing may be adapted to be disposed between the flange end of the fuze and a fuze well; and wherein the circular cap housing may include an interior space defined by the first annular space and the second annular space; and a plurality of cripple studs disposed within the interior space of the circular cap housing and including: one or more first cripple studs, each comprising: a first web portion located within the first annular space and having a first end orthogonally adjoining the first outer cylindrical sidewall; and a second web portion located with the first annular space and having a first end orthogonally adjoining the first inner cylindrical sidewall; wherein second ends of the first and second web portions of the one or more first cripple studs may adjoin and partially overlap each other to form one or more first single steps; one or more second cripple studs, each comprising: a first web portion located substantially between the first and second annular spaces and having a first end adjoining the first outer cylindrical sidewall; and a second web portion located substantially between the first and second annular spaces and having a first end adjoining the top end of the first inner cylindrical sidewall and the outer circumference of the intermediate portion; wherein second ends of the first web portions and the second web portions of the one or more second cripple studs may adjoin and partially overlap each other to form one or more second single steps; and one or more third cripple studs, each comprising: a first web portion located within the second annular space and having a first end orthogonally adjoining the first top portion; a second web portion located within the second annular space and having a first end orthogonally adjoining the intermediate portion; and a third web portion extending to and orthogonally adjoining second ends of the first and second web portions of the one or more third cripple studs to form a one or more third single steps; and a shock resistant collar, comprising: a ring-shaped housing having a third annular space defined by: a second outer cylindrical sidewall; a third inner cylindrical sidewall concentrically disposed within the second outer cylindrical sidewall and defining a center opening of the ring-shaped housing, the center opening being adapted to snugly insert a fuze body of a fuze; a second bottom portion, generally ring-shaped, and having an inner circumference adjoining a bottom end of the third inner cylindrical sidewall and an outer circumference adjoining a bottom end of the second outer cylindrical sidewall; and a second top portion, generally ring-shaped, and having an inner circumference adjoining a top end of the third inner cylindrical sidewall and an outer circumference adjoining a top end of the second outer cylindrical sidewall; and one or more fourth cripple studs located within the third annular space of the ring-shaped housing and radially disposed around the third inner cylindrical sidewall, wherein each of the one or more fourth cripple studs may comprise: a vertical web portion having a bottom end orthogonally adjoining the second bottom portion and at top end orthogonally adjoining the second top portion; and a horizontal web portion having a first end orthogonally adjoining the third inner cylindrical sidewall and a second end orthogonally adjoining the second outer cylindrical sidewall; wherein mid-sections of the vertical web portion and the horizontal web portion may orthogonally adjoin together, such that each of the one or more fourth cripple studs may be substantially cross-shaped; wherein the ring-shaped housing may have a center opening adapted to snugly insert a fuze body of a fuze; and wherein the ring-shaped housing may have an outer diameter less than a diameter of the receptacle of the circular cap housing, such that when the fuze body is snugly fit within the center opening of the ring-shaped housing, the ring-shaped housing may be adapted to fit within the receptacle of the circular cap housing, the fuze well, and the flange end of the fuze. The ring-shaped housing, the circular cap housing, and the one or more first, second, third, and fourth cripple studs may be constructed of a metal; and wherein the first, second, and third web portions of the one or more first, second, and third cripple studs and the vertical and horizontal web portions of the one or more fourth cripple studs may have a maximum thickness of 0.25 inches, such that the one or more first, second, third, and fourth cripple studs may be semi-rigid. The circular cap housing may be filled with a urethane polymer. The ring-shaped housing may be filled with a urethane polymer. The one or more fourth cripple studs may be oriented in spaced parallel relation to each other. The circular cap housing and the one or more first, second, and third cripple studs may form a single unitary piece. The ring-shaped housing and the one or more fourth cripple studs may form a single unitary piece. The ring-shaped housing may be generally circular. The shock resistant fuze cap and collar combination may further comprise a retaining ring adapted to fit within the fuze well when the shock resistant fuze cap, the shock resistant collar, and the fuze are installed within the fuze well. The flange end of the fuze may be disposed between the shock resistant fuze cap and the shock resistant collar when the shock resistant collar and the shock resistant fuze cap are engaged with the flange end of the fuze and installed within the fuze well.

It is an object to overcome the limitations of the prior art.

These, as well as other components, steps, features, objects, benefits, and advantages, will now become clear from a review of the following detailed description of illustrative embodiments, the accompanying drawings, and the claims.

BRIEF DESCRIPTION OF THE DRAWINGS

The drawings are illustrative embodiments. They do not illustrate all embodiments. They do not set forth all embodiments. Other embodiments may be used in addition or instead. Details, which may be apparent or unnecessary, may be omitted to save space or for more effective illustration. Some embodiments may be practiced with additional components or steps and/or without all of the components or steps, which are illustrated. When the same numeral appears in different drawings, it is intended to refer to the same or like components or steps.

DETAILED DESCRIPTION OF ILLUSTRATIVE EMBODIMENTS

Figure 1:
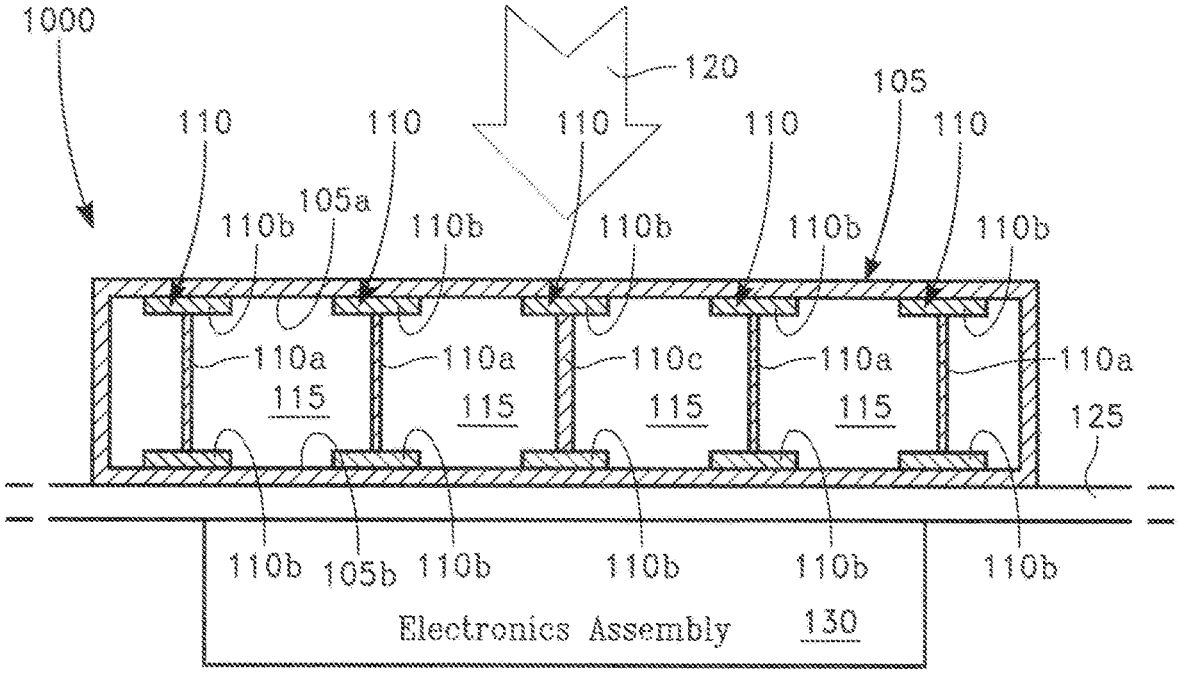
FIG. 1 is an illustration of a cross section view of one embodiment of a shock resistant mounting structure for fuze systems.

In the following detailed description, numerous specific details are set forth in order to provide a thorough understanding of various aspects of one or more embodiments of the shock resistant mounting structures for fuze systems. However, these embodiments may be practiced without some or all of these specific details. In other instances, well-known methods, procedures, and/or components have not been described in detail so as not to unnecessarily obscure the aspects of these embodiments.

Before the embodiments are disclosed and described, it is to be understood that these embodiments are not limited to the particular structures, process steps, or materials disclosed herein, but is extended to equivalents thereof as would be recognized by those ordinarily skilled in the relevant arts. It should also be understood that the terminology used herein is used for the purpose of describing particular embodiments only and is not intended to be limiting.

Reference throughout this specification to "one embodiment," "an embodiment," or "another embodiment" may refer to a particular feature, structure, or characteristic described in connection with the embodiment of the present disclosure. Thus, appearances of the phrases "in one embodiment" or "in an embodiment" in various places throughout this specification may not necessarily refer to the same embodiment.

Furthermore, the described features, structures, or characteristics may be combined in any suitable manner in various embodiments. In the following description, numerous specific details are provided, such as examples of materials, fasteners, sizes, lengths, widths, shapes, etc. . . . to provide a thorough understanding of the embodiments. One skilled in the relevant art will recognize, however, that the scope of protection can be practiced without one or more of the specific details, or with other methods, components, materials, etc. . . . In other instances, well-known structures, materials, or operations are generally not shown or described in detail to avoid obscuring aspects of the disclosure.

Definitions

In the following description, certain terminology is used to describe certain features of the embodiments of the shock resistant mounting structures for fuze systems. For example, as used herein, unless otherwise specified, the term "substantially" refers to the complete, or nearly complete, extent or degree of an action, characteristic, property, state, structure, item, or result. As an arbitrary example, an object that is "substantially" surrounded would mean that the object is either completely surrounded or nearly completely surrounded. The exact allowable degree of deviation from absolute completeness may in some cases depend on the specific context. However, generally speaking, the nearness of completion will be so as to have the same overall result as if absolute and total completion were obtained.

The use of "substantially" is equally applicable when used in a negative connotation to refer to the complete or near complete lack of an action, characteristic, property, state, structure, item, or result. As another arbitrary example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, the term "semi-rigid" generally refers to a characteristic of the cripple studs wherein the cripple studs generally hold their respective shapes and provide support to the shock resistant mounting structure, shock resistant fuze cap, shock resistant collar, fuze, fuze well, or fuze assembly but is capable of being physically deformed to divert extreme shocks or vibrations from the fuze, fuze well, or fuze assembly.

As used herein, the term "approximately" may refer to a range of values of ±10% of a specific value.

As used herein, the term "near" refers to a region within close proximity of an intended point, position, or target. The term "near" may also refer to being at the intended point, position, or target.

As used herein the term "somewhat" refers to a range of values of ±50% of a specific value.

As used herein, the term "about" is used to provide flexibility to a numerical range endpoint by providing that a given value may be "a little above" or "a little below" the endpoint. In some cases, the term "about" is to include a range of not more than about two inches of deviation.

By way of illustration, a numerical range of "about 1 inch to about 5 inches" should be interpreted to include not only the explicitly recited values of about 1 inch to about 5 inches, but also include individual values and sub-ranges within the indicated range. Thus, included in this numerical range are individual values such as 2, 3, and 4 and sub-ranges such as from 1-3, from 2-4, and from 3-5.

This same principle applies to ranges reciting only one numerical value and should apply regardless of the breadth of the range or the characteristics being described.

Distances, forces, weights, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited.

This same principle applies to ranges reciting only one numerical value and should apply regardless of the breadth of the range or the characteristics being described.

As used herein in this disclosure, the singular forms "a" and "the" may include plural referents, unless the context clearly dictates otherwise.

The present disclosure relates generally to mounting structures that minimize, divert, or eliminate extreme shocks. In general, when sensitive electronics are subject to sudden force or impact, shock energy may travel and physically damage the electronics. Shock testing may help prevent or mitigate such damage by subjecting a test device to sudden and extreme amounts of acceleration or deceleration and determining to what degree items can physically withstand relatively infrequent forces or mechanical vibrations. During pyroshock testing or warhead penetration testing, for example, extreme shock waves may travel through various mounting structures and advance into a fuze system. These shock waves may mechanically break the electronics, often impairing or disabling the warhead and disrupting mission critical events.

Embodiments of the shock resistant mounting structure for fuze systems disclosed herein solve this problem by interfacing the fuze system with a plurality of cripple studs that divert or physically deform when subject to extreme shocks or vibrations. For example, one embodiment of the shock resistant mounting structure may be a shock resistant fuze cap, comprising a circular cap housing configured to engage and disengage a flange end of a fuze. The circular cap housing may comprise a plurality of cripple studs disposed within the circular cap housing, and the cripple studs may deform when experiencing extreme shock or vibrations.

In another embodiment, the shock resistant mounting structure may be a shock resistant fuze cap and shock resistant collar combination adapted to interface a flange end of a fuze. The shock resistant fuze cap may engage a flange end and upper portion of the fuze and may comprise cripple studs disposed therein. The shock resistant collar may engage with the fuze body and may likewise comprise cripple studs to mechanically deform upon receiving extreme shock. In this manner, both the shock resistant fuze cap and shock resistant collar may absorb or divert extreme shock loading energy from damaging critical electronic components.

In the accompany drawings, like reference numbers indicate like elements. Reference characters 1000, 2000, 3000, 3100, 3200 depict various embodiments of the shock resistant mounting structures for fuze systems.

FIG. 1 is an illustration of a cross section view of one embodiment of a shock resistant mounting structure 1000 for fuze systems. The shock resistant mounting structure 1000 may be adapted to interface sensitive electronics by mounting the shock resistant mounting structure 1000 onto an electronics mounting surface 125 directly onto a pathway between a potential shock energy 120 and electronics assembly 130. This may allow shock energy 120 traveling through the housing 105 to be absorbed or dissipated upon arrival of the shock resistant mounting structure 1000.

As shown in FIG. 1, one embodiment of the shock resistant mounting structure 1000 may comprise a housing 105 and a plurality of cripple studs 110. The housing 105 may be a rigid casing that houses and encloses the cripple studs 110. The cripple studs 110 may be special-purpose structural members that are physically coupled to and between at least two interior sides of the housing 105. In other embodiments, the cripple studs 110 may be integrated with the shock resistant housing 105 as a single or unitary piece. Importantly, the cripple studs 110 may be semi-rigid but adapted to physically deform upon receiving shock energy 120.

Embodiments of the cripple studs 110 may be manufactured in various shapes and may comprise at least two flange ends 110*b* coupled to the inner opposing sides 105*a*, 105*b* of the housing 105 and a web portion 110*a*, 110*c* that extends between the flange ends 110*b*. For example, as shown in FIG. 1, one embodiment of the cripple studs 110 may have a web portion 110*a*, 110*c* extending between the flange ends 110*b* located at the inner opposing sides 105*a*, 105*b* of the housing 105, such that the cripple studs 110 may resemble an I-beam. The flange ends 1106 may also provide vertical support to the web portions 110*a*, 110*c*. Importantly, the web portions 110*a*, 110*c* may be constructed of slightly stiff material (e.g., metal) and preferably have a maximum thickness of 0.25 inches. This may allow the web portions 110*a* to be semi-rigid in order to deform when subjected to shock energy 120, yet strong enough to withstand typical forces and stresses associated with everyday use and misuse. In other embodiments, the web portions 110*a*, 110*c* or the cripple studs 110 may have varying thicknesses, as shown in FIG. 1. For example, web portion 110*c* may have a larger thickness than web portion 110*a*. Additionally, each cripple stud 110 may be in spaced parallel relation with each other, as shown in FIG. 1, and may be oriented directly within the loading path and buckle between the electronic assembly 130 and shock energy 120. In this manner, the cripple studs 110 may deform or break at a prescribed loading condition.

The shock resistant mounting structures 1000 may be constructed of various materials. For example, in one embodiment, the shock resistant mounting structure 1000 may be constructed of a metal. Examples of such metals may include, without limitation: aluminum, titanium alloy, nickel alloy (e.g., Inconel®), and maraging steel. In another embodiment, the shock resistant mounting structure 1000 may be cast or additively manufactured.

In another embodiment, the shock resistant mounting structure 1000 may also be filled with an insulating liquid compound such as urethane polymer 115. Specifically, urethane polymer 115 may be used to fill the housing 105 to further damp shock or vibrational energy at frequencies spectra known to excite printed circuit board mounted electronic components. Preferably, an insulating liquid compound that solidifies is used in order to permanently protect the cripple studs 110 and assembly. The urethane polymer 115 may provide shielding or heat dissipating functions in addition to preventing or mitigation extreme shock. Other embodiments that may be used to also fill the shock resistant mounting structure 1000 may include, without limitation, epoxy potting compounds, urethane potting compounds, and silicone potting compounds.

Figure 2:
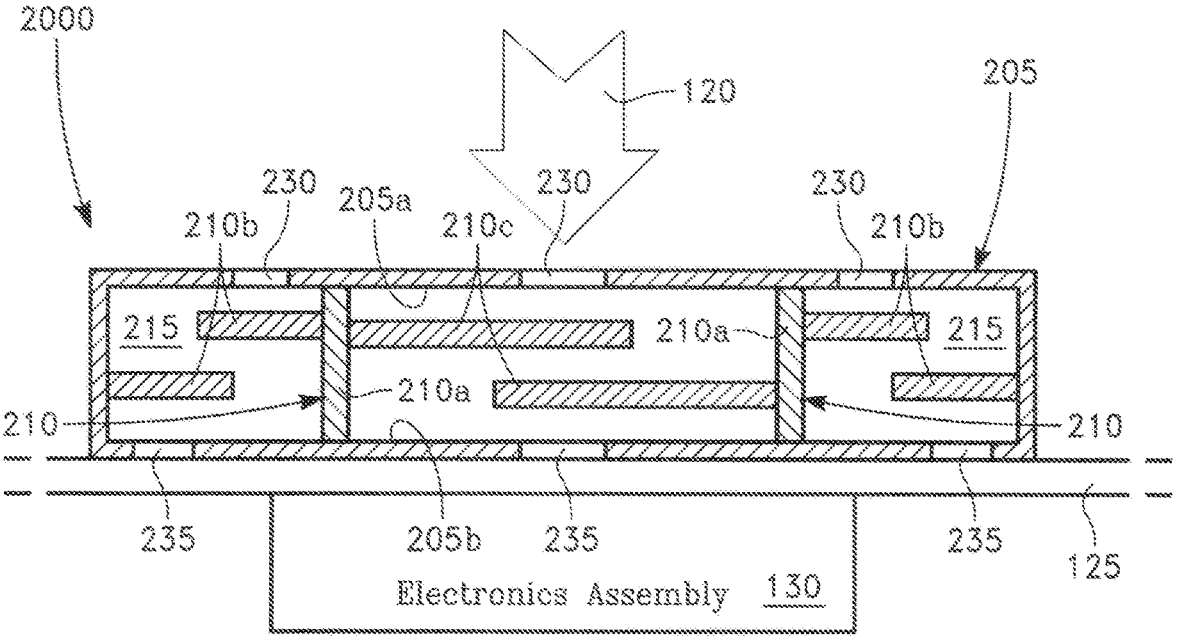
FIG. 2 is an illustration of a cross section view of another embodiment of the shock resistant mounting structure for fuze systems.

FIG. 2 is an illustration of a cross section view of another embodiment of the shock resistant mounting structure 2000. As shown in FIG. 2, another embodiment of the shock resistant mounting structure 2000 may comprise a housing 205 and a plurality of cripple studs 210 disposed within the housing 205. Like the previous embodiment, the housing 205 may be a rigid casing that houses and encloses the cripple studs 210. The cripple studs 210 may be special-purpose structural members coupled to and disposed between at least two interior sides of the housing 205. The cripple studs 210 are also preferably adapted to physically deform when subjected to high-amplitude shock energy 120 or forces.

FIG. 2 also shows that another embodiment of the shock resistant mounting structure 2000 may comprise a housing 205 having fill ports 230 and vacuum ports 235. In particular, the housing 205 may having a first side 205*a* with one or more fill ports 230 and a second side 205*b* with one or more vacuum ports 235. The fill ports 230 are preferably openings or apertures that allow liquid to enter into the shock resistant mounting structure 2000. The vacuum ports 235 are preferably openings or apertures used for applying negative air pressure to remove any excess gas or liquid. The fill ports 230 and vacuum ports 235 are preferably in fluid communication with each other such that filling the shock resistant mounting structure 2000 with the insulating liquid compound (e.g., urethane polymer) via the fill port 230 may be performed without the inclusion of voids. Although FIG. 2 shows fill ports located on one side of the housing and vacuum ports located on the opposing side of the housing, other embodiments of the shock resistant mounting structure may have fill ports and vacuum ports on the same side.

Unlike the previous embodiment shown in FIG. 1, FIG. 2 also shows that another embodiment of the cripple studs 210 may lack flange ends but may comprise a web portion 210*a* and one or more cantilever portions 210*b* extending from the web portion 210*a*. As shown in FIG. 2, the cripple studs 210 may be oriented in spaced parallel relation to each other, and the cantilever portions 210 may be disposed in opposing relation 210*b* to each other. In this manner, the urethane polymer may travel thoroughly in between the web portions 210*a* and cantilever portions 210*b* of the cripple studs 210. Like the previous embodiment shown in FIG. 1, each web portion 210*a* preferably has a thickness of no more than 0.25 inches in order for the cripple studs 210 to be semi-rigid. As noted above, the web portions 210*a* may be semi-rigid for deforming or absorbing shock energy 120 or break at a prescribed loading condition.

Figure 3A:
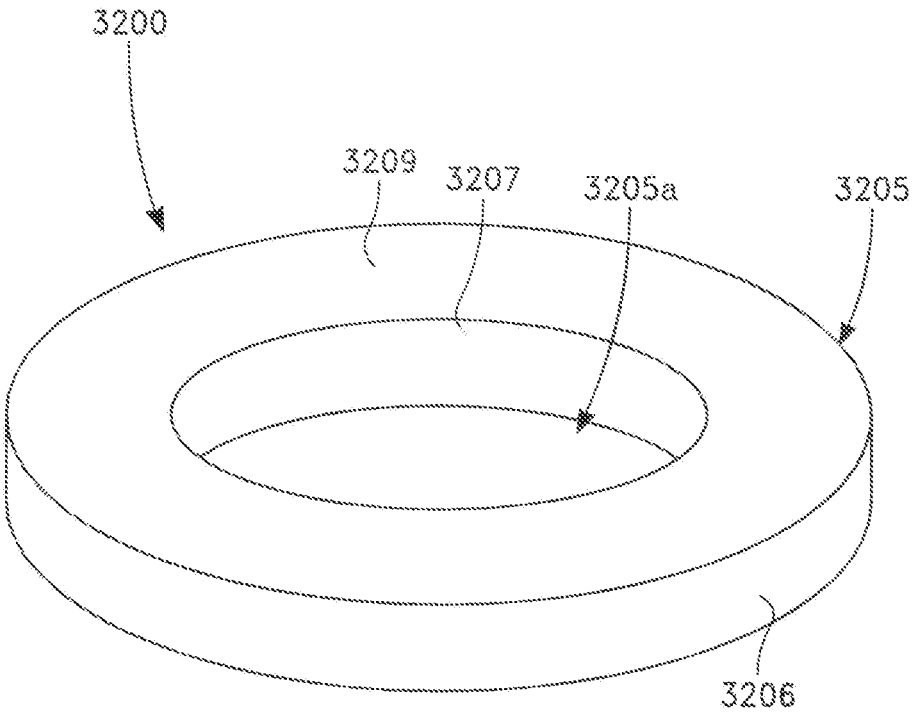
FIGS. 3A to 3C are illustrations of perspective, side elevation, and top plan views, respectively, of another embodiment of the shock resistant mounting structure, which may be a shock resistant collar.
Figure 3B:
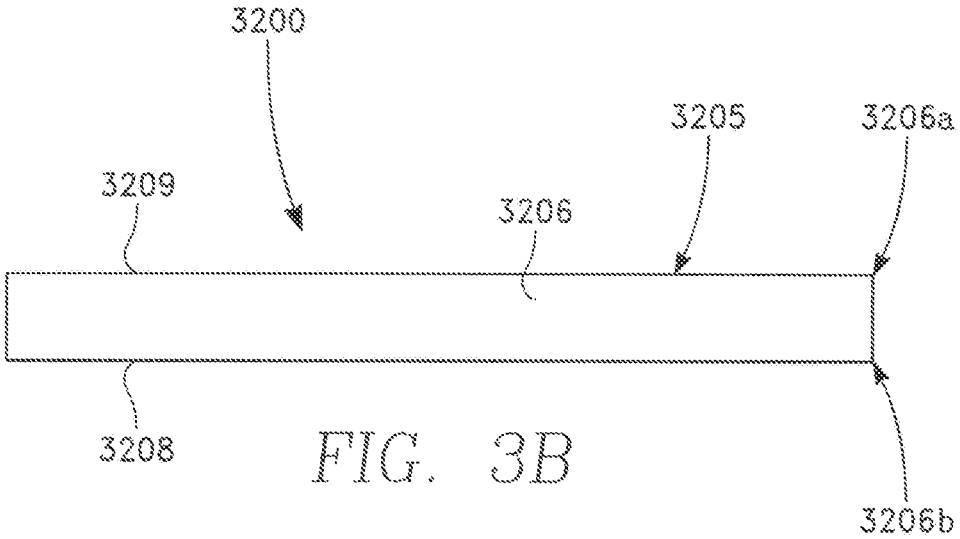
Figure 3C:
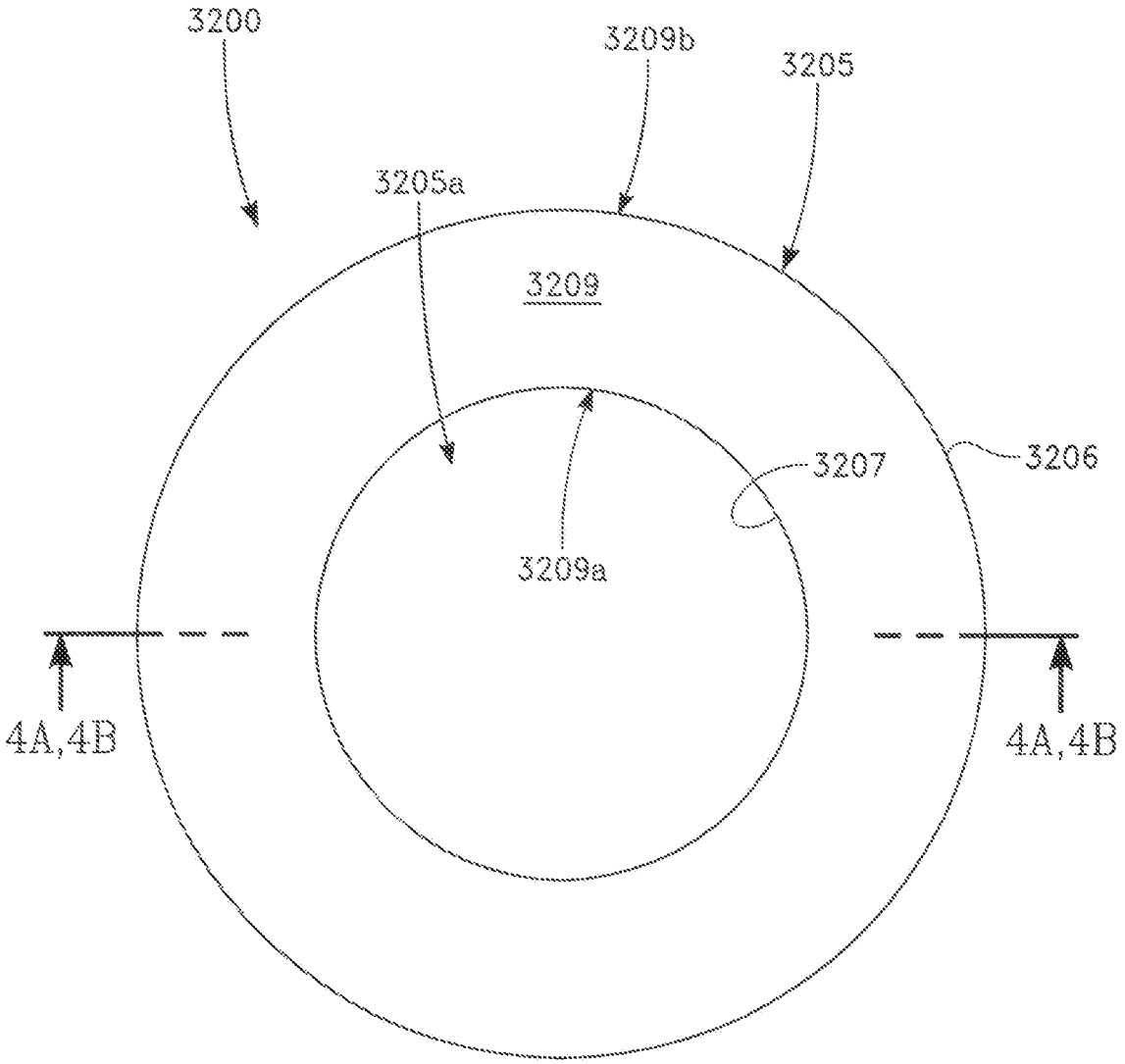
Figure 8A:
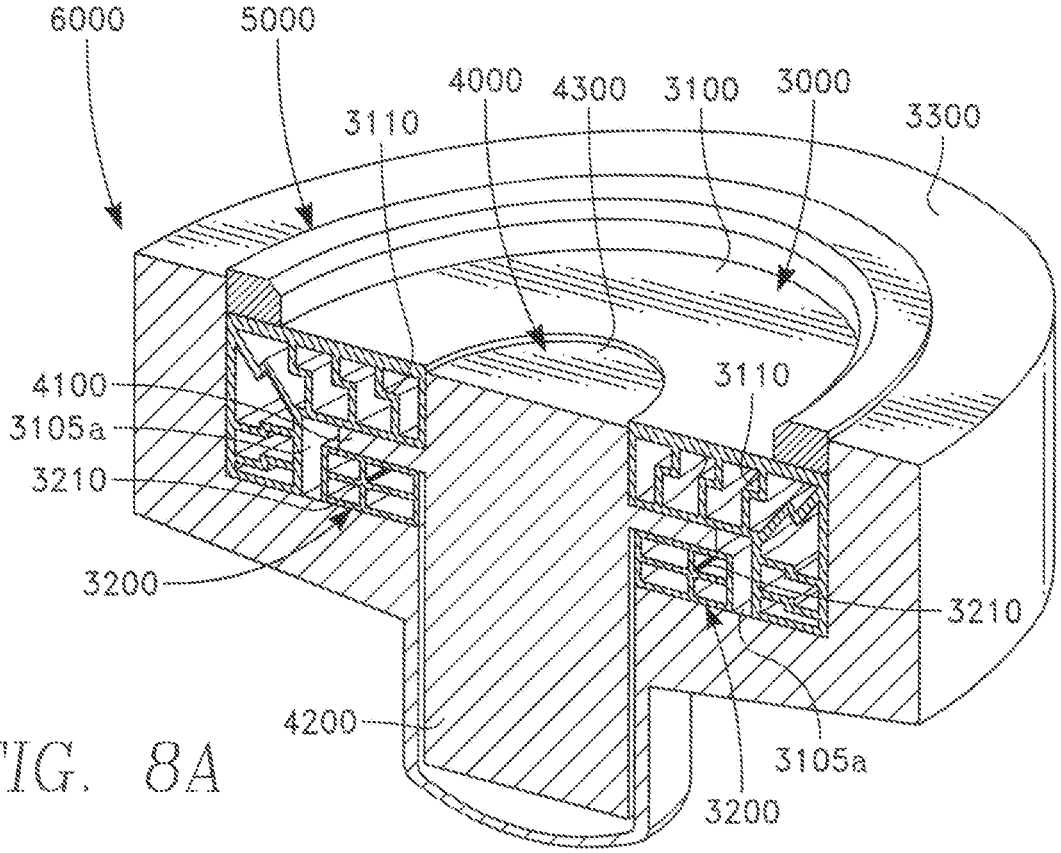
FIGS. 8A and 8B are illustrations of perspective and side elevation, cross section views, respectively, of the fuze assembly with embodiments of the shock resistant collar and shock resistant fuze cap installed thereon.
Figure 8B:
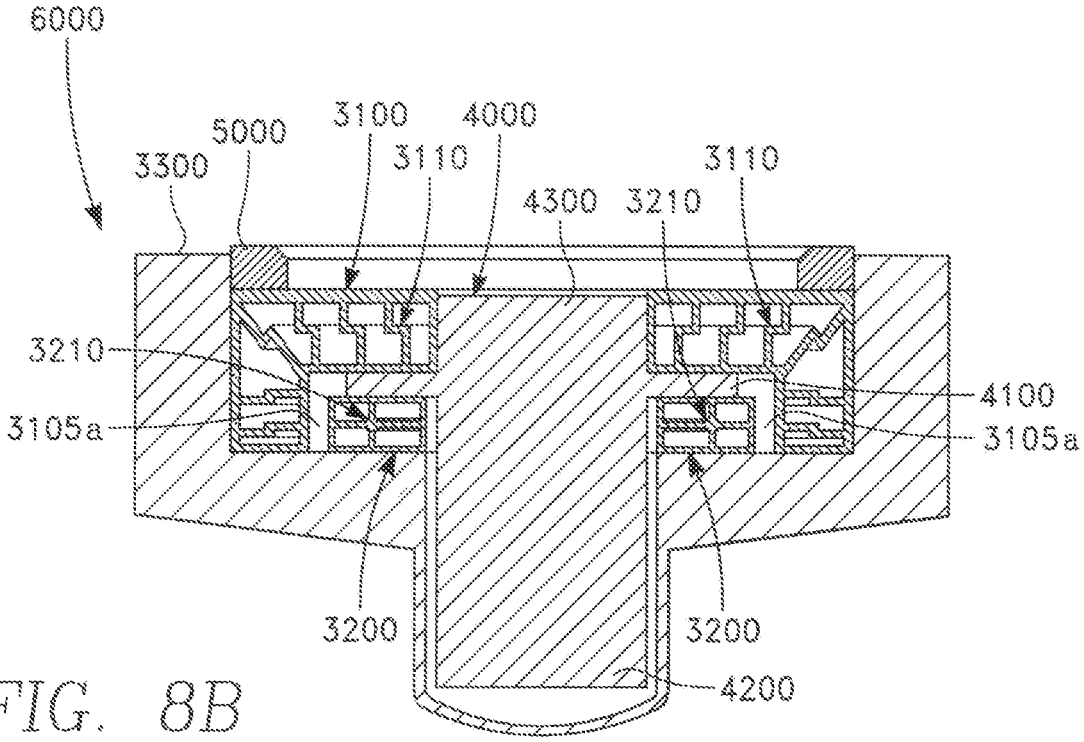

FIGS. 3A to 3C are illustrations of perspective, side elevation, and top plan views, respectively, of another embodiment of the shock resistant mounting structure, which may be a shock resistant collar 3200. The shock resistant collar 3200 is preferably adapted to engage a fuze body 4200 of a fuze 4000 (shown in FIGS. 8A and 8B) and may be adapted to position beneath the flange end 4100 of the fuze 4000 when engaged with the fuze body 4200. Thus, when coupled to the fuze body 4200 while installed within a fuze well 3300, the shock resistant collar 3200 may be disposed between the flange end 4100 of the fuze 4000 and fuze well 3300, as shown in FIGS. 8A and 8B.

Embodiments, the shock resistant collar 3200 may comprise one or more cripple studs 3210 (shown in FIGS. 4A and 4B) and a ring-shaped housing 3205, configured to house the cripple stud(s) 3210. In various embodiments, the ring-shaped housing 3205 may also be filled with an insulating liquid compound such as urethane polymer 115.

As shown in FIGS. 3A to 3C, the ring-shaped housing 3205 may comprise: an outer cylindrical sidewall 3206, inner cylindrical sidewall 3207, bottom portion 3208, and top portion 3209. The outer cylindrical sidewall 3206 and inner cylindrical sidewall 3207 may be cylindrical portions of the ring-shaped housing 3205, and the inner cylindrical sidewall 3207 may be concentrically disposed within the outer cylindrical sidewall 3206. Thus, the inner cylindrical sidewall 3207 preferably has a smaller diameter than the outer cylindrical sidewall 3206. The outer cylindrical sidewall 3206 and inner cylindrical sidewall 3207 may also have approximately the same height. Preferably, the inner cylindrical sidewall 3207 has a center opening 3205*a* adapted to snugly insert a fuze body 4200 of a fuze 4000, as shown in FIGS. 8A and 8B.

The top portion 3209 and bottom portion 3208 may be flat, circular portions that are substantially ring-shaped and may have center openings that adjoin the inner cylindrical sidewall 3207. In an exemplary embodiment, the top portion 3209 and the bottom portion 3208 may be the same size and shape. Notably, the bottom portion 3208 may have an inner circumference 3208*a* adjoining a bottom end 3207*b* of the inner cylindrical sidewall 3207, and the top portion 3209 may have an inner circumference 3209*a* adjoining a top end 3207*a* of the inner cylindrical sidewall 3207 (shown in FIGS. 4A and 4B). The outer circumferences 3208*b*, 3209*b* of the top portion 3209 and bottom portion 3208 may also adjoin the outer cylindrical sidewall 3206. In particular, the outer circumference 3209*b* of the top portion 3209 may adjoin the top end 3206*a* of the outer cylindrical sidewall 3206, and the outer circumference 3208*b* of the bottom portion 3208 may adjoin the bottom end 3206*b* of the outer cylindrical sidewall 3206. As such, the outer cylindrical sidewall 3206, inner cylindrical sidewall 3207, bottom portion 3208, and top portion 3209 altogether may form a housing substantially shaped as a ring having an annular space 3205*b* for housing the cripple stud(s) 3210. Details of the cripple studs 3210 of the shock resistant collar 3200 are described below in FIGS. 4A to 4B.

Figure 4A:
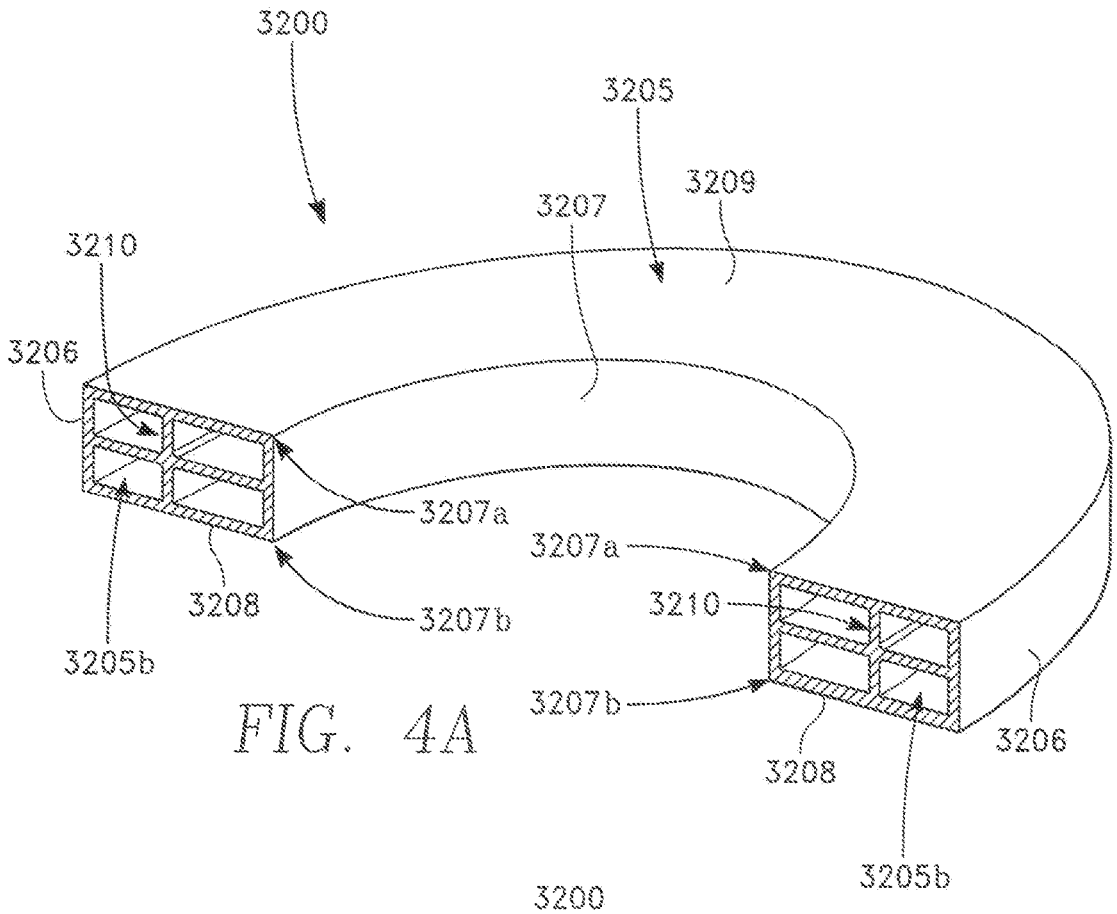
FIGS. 4A and 4B are illustrations of perspective and side elevation, cross section views, respectively, of one embodiment of the shock resistant collar and shows one or more cripple studs within the ring-shaped housing.
Figure 4B:
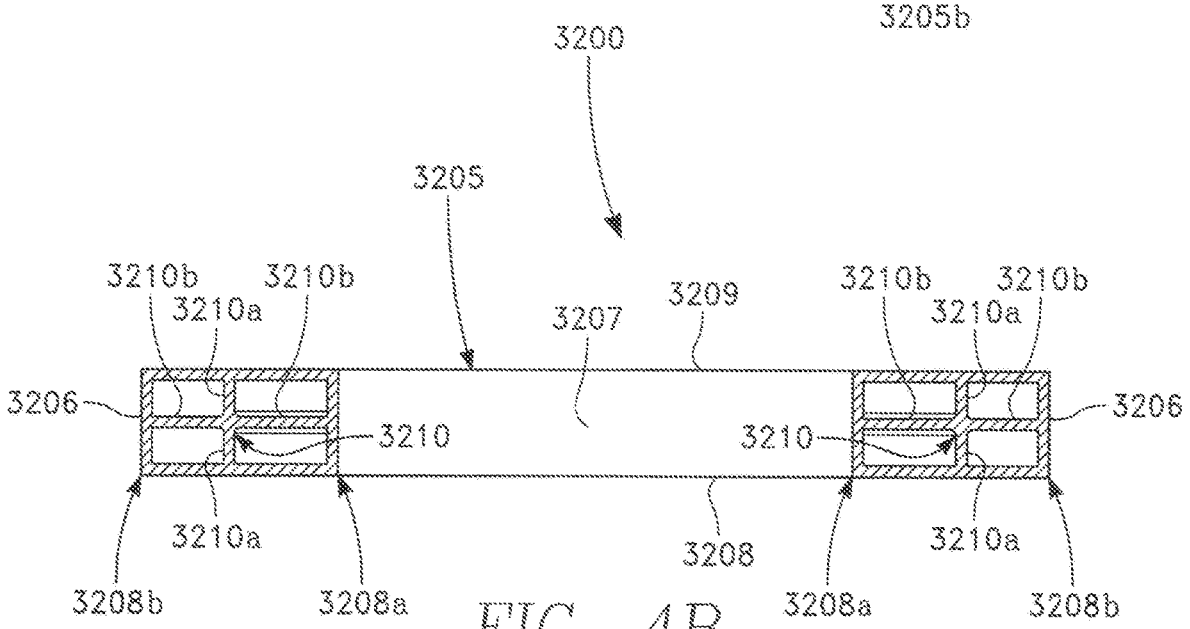
Figure 5A:
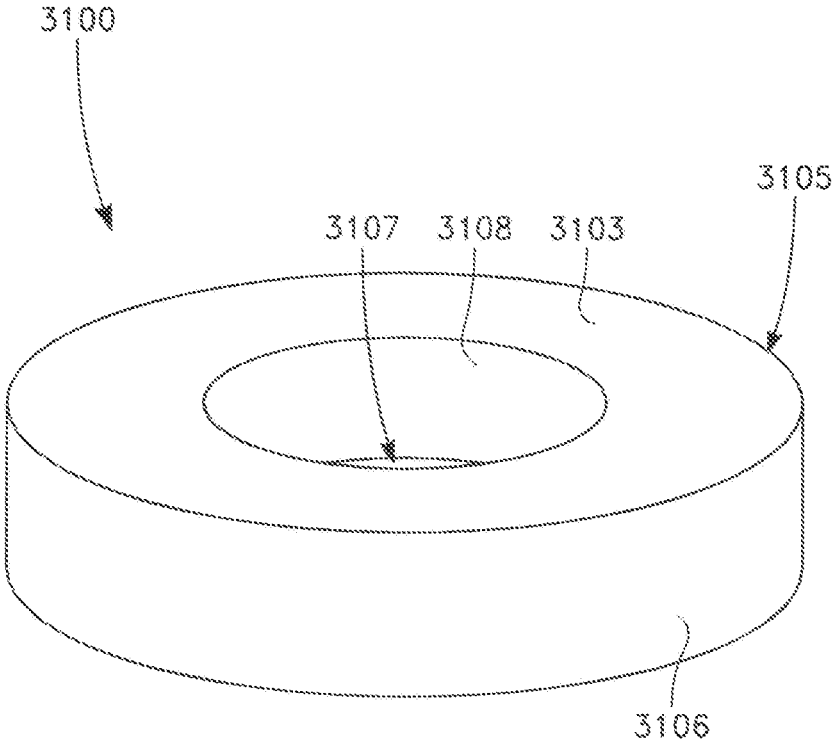
FIGS. 5A to 5D are illustrations of top perspective, side elevation, top plan, and bottom plan views, respectively, of another embodiment of the shock resistant mounting structure, which may be a shock resistant fuze cap.
Figure 5B:
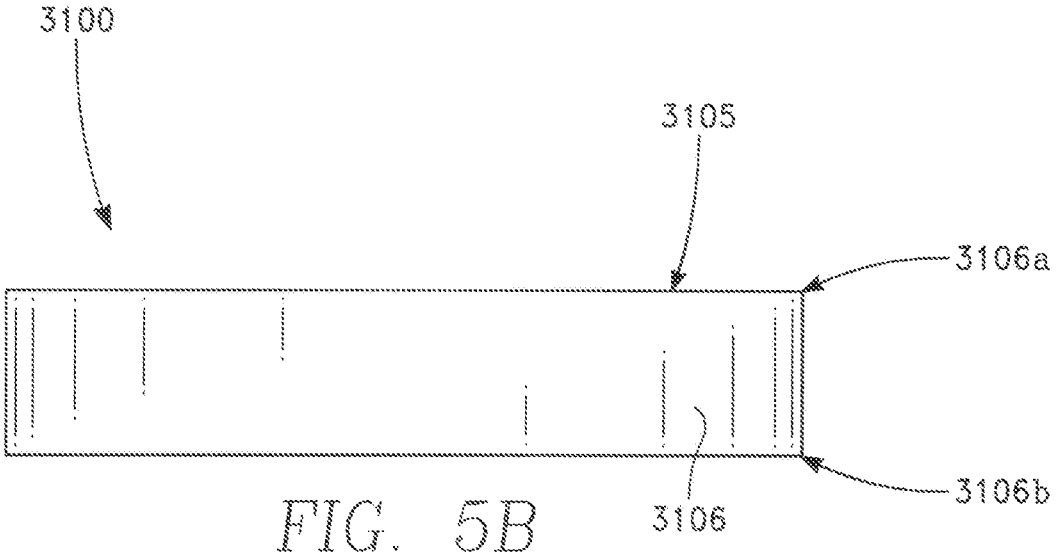
Figure 5C:
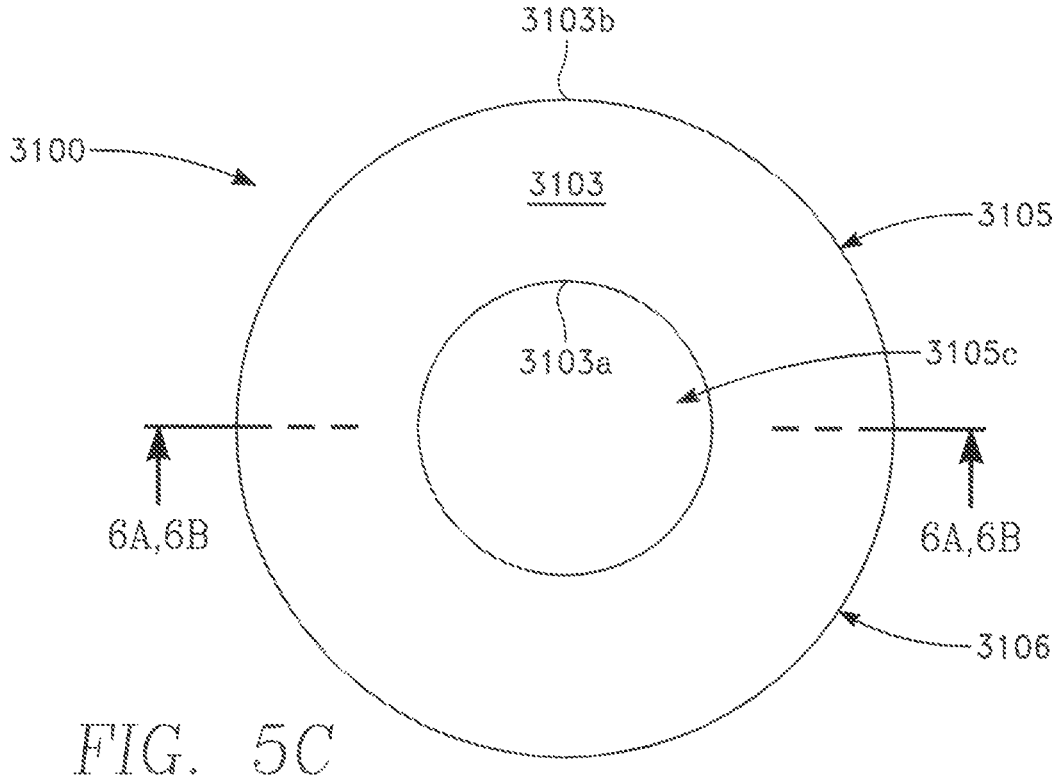
Figure 5D:
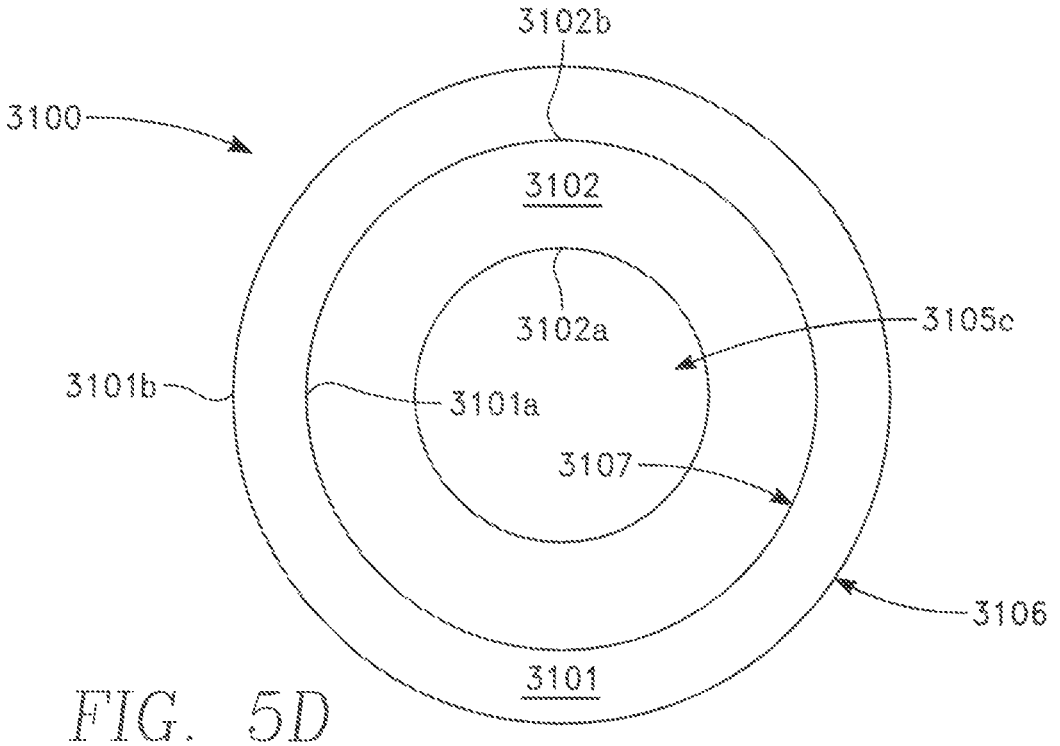

FIGS. 4A and 4B are illustrations of perspective and side elevation, cross section views, respectively, of one embodiment of the shock resistant collar 3200 and shows one or more cripple studs 3210 disposed within the ring-shaped housing 3205. As shown in FIGS. 4A and 4B, one embodiment of the shock resistant collar 3200 may comprise a ring-shaped housing 3205 and cripple stud(s) 3210. Additionally, in other embodiments, an insulating liquid compound such as urethane polymer 115 may fill the annular space of the ring-shaped housing 3205.

As recited above, the center opening 3205*a* of the ring-shaped housing 3205 is preferably adapted to engage the fuze body 4200 of a fuze 4000, and the ring-shaped housing 3205 may be configured to house the cripple stud(s) 3210. Like the previous embodiments shown in FIGS. 1 and 2, the cripple studs 3210 may be semi-rigid, special-purpose structural members that are physically coupled to or integrated with at least two interior, opposing sides of the ring-shaped housing 3205. The cripple stud(s) 3210 may also be configured to absorb or physically deform when subjected to shock loading energy 120. Notably, the cripple stud(s) 3210 are preferably located within the annular space 3205*b* of the ring-shaped housing 3205 and may be radially disposed around the inner cylindrical sidewall 3207 in order to allow shock loading energy 120 entering from outside the fuze well 3300 to first travel along the cripple studs 3210 prior to contacting the fuze 4000.

FIGS. 4A and 4B show that each cripple stud 3210 of the shock resistant collar 3200 may comprise: a vertical web portion 3210*a* and a horizontal web portion 3210*b*. The vertical web portion 3210*a* may have a bottom end orthogonally adjoining the bottom portion 3208 of the ring-shaped housing 3205, and the vertical web portion 3210*a* may have a top end orthogonally adjoining the top portion 3209 of the ring-shaped housing 3205. Similarly, the horizontal web portion 3210*b* may have a first end orthogonally adjoining the inner cylindrical sidewall 3207. The horizontal web portion 3210*b* may also have a second end orthogonally adjoining the outer cylindrical sidewall 3206. Further, mid-sections of the vertical web portions 3210*a* and the horizontal web portions 3210*b* may adjoin together, such that the vertical web portion 3210*a* and the horizontal web portion 3210*b* may extend within opposing sides of the ring-shaped housing 3105. In this manner, each of the cripple studs 3210 of the shock resistant collar 3200 may be substantially cross-shaped, as shown in FIGS. 4A and 4B. In other embodiments, each cripple stud 3210 may have various shapes such as those cripple studs 110, 210 shown in FIGS. 1 and 2.

Importantly, the vertical web portion 3210*a* and a horizontal web portion 3210*b* of the cripple studs 3210 may be constructed of a slightly stiff material (e.g., metal) and preferably have a maximum thickness of 0.25 inches. This may allow the vertical web portion 3210*a* and a horizontal web portion 3210*b* to be semi-rigid in order to deform when subjected to shock energy 120, yet strong enough to withstand typical forces and stresses associated with everyday use and misuse. In other embodiments, the vertical web portion 3210*a* and a horizontal web portion 3210*b* may have varying thicknesses. In various embodiments involving multiple cripple studs, each cripple stud 3210 may be in spaced parallel relation with each other and may be radially disposed around the inner cylindrical sidewall 3207 within the ring-shaped housing 3205. In this manner, the cripple stud(s) 3210 may deform or break when subjected to shock energy 120 entering towards the fuze 4000 through the shock resistant collar 3200.

FIGS. 5A to 5D are illustrations of top perspective, side elevation, top plan, and bottom plan views, respectively, of another embodiment of the shock resistant mounting structure, which may be a shock resistant fuze cap 3100. The shock resistant fuze cap 3100 is preferably a cover or cap adapted to engage and cover an upper portion 4300 and flange end 4100 of a fuze 4000 and may comprise a circular cap housing 3105 and multiple cripple studs 3110 (shown in FIGS. 6A and 6B). In other embodiments, the circular cap housing 3105 may also be filled with an insulating liquid compound such as urethane polymer 115 in order to further dampen shock or vibrational energy entering the shock resistant fuze cap 3100. To further protect the upper portion 4300 of the fuze 4000 within the fuze well 3300, the circular cap housing 3105 may be substantially circular and have a protruding circular edge 3105*b* in order to form receptacle 3105*a*. The receptacle 3105*a* may be configured to engage a flange end 4100 of the fuze 4000, such that the flange end 4100 of the fuze 4000 may fit within the receptacle 3105*a* of the circular cap housing 3105.

As shown in FIGS. 5A to 5D, the circular cap housing 3105 may comprise: an outer cylindrical sidewall 3106, first inner cylindrical sidewall 3107, second inner cylindrical sidewall 3108, bottom portion 3101, intermediate portion 3102, and top portion 3103. The outer cylindrical sidewall 3106 is preferably a cylindrical portion adapted to snugly fit within a fuzewell 3300. Similarly, the first inner cylindrical sidewall 3107 and second inner cylindrical sidewall 3108 may likewise be cylindrical portions of the circular cap housing 3105, wherein both may have a smaller diameter than the outer cylindrical sidewall 3106. Importantly, the first inner cylindrical sidewall 3107 may be concentrically disposed within the bottom end 3106*b* of the outer cylindrical sidewall 3106, while the second inner cylindrical sidewall 3108 may be concentrically disposed within the top end 3106*a* of the outer cylindrical sidewall 3106. Notably, the second inner cylindrical sidewall 3108 may have a smaller diameter than the first inner cylindrical sidewall 3207 and may define a center opening 3105*c* preferably adapted to snugly engage an upper portion 4300 of the fuze 4000.

The bottom portion 3101 may be a flat, circular portion that is generally ring-shaped. The bottom portion 3101 may also have an inner circumference 3101*a* adjoining a bottom end 3107*b* of the first cylindrical sidewall 3107 and an outer circumference 3101*b* adjoining the bottom end 31066 of the outer cylindrical sidewall 3106. In this manner, the outer cylindrical sidewall 3106, first inner cylindrical sidewall 3107, and bottom portion 3101 may altogether form a first annular space 3105*d* within the circular cap housing 3105.

The intermediate portion 3102 may be a flat, circular portion that is generally disc-shaped (i.e., having an inner circumference 3102*a* that is substantially smaller than the inner circumference 3101*a* of the ring-shaped bottom portion 3101). Importantly, the intermediate portion 3102 may also have an inner circumference 3102*a* that adjoins the bottom end 3108*b* of the second inner cylindrical sidewall 3108 and an outer circumference 3102*b* that adjoins the top end 3107*a* of the first cylindrical sidewall 3107. In this manner, the first inner cylindrical sidewall 3107 and the intermediate portion 3102 may form a receptacle 3105*a* configured to fit a flange end 4100 of a fuze 4000.

Like the intermediate portion 3102, the top portion 3103 may be a flat, circular portion that is generally disc-shaped (i.e., having an inner circumference 3103*a* that is substantially smaller than the inner circumference 3101*a* of the ring-shaped bottom portion 3101). Importantly, the top portion 3103 may have an outer circumference 3103*b* that adjoins the top end 3106*a* of the outer cylindrical sidewall 3106 and an inner circumference 3103*a* that adjoins the top end 3108*a* of the second inner cylindrical sidewall 3108. In this manner, the top portion 3103, second inner cylindrical sidewall 3108, and intermediate portion 3102 may altogether form a second annular space 3105*e* within the circular cap housing 3105. Given that the bottom portion 3101, intermediate portion 3102, and top portion 3103 may be substantially flat, the cumulative heights of the first inner cylindrical sidewall 3107 and second inner cylindrical sidewall 3108 may be approximately the same height as the outer cylindrical sidewall 3106.

Preferably, the circular cap housing 3105 is adapted to be disposed between the flange end 4100 of the fuze 4000 and a fuze well 3300. The circular cap housing 3105 also preferably includes an interior space defined by both the first annular space 3105*d* and second annular space 3105*e*.

Figure 6A:
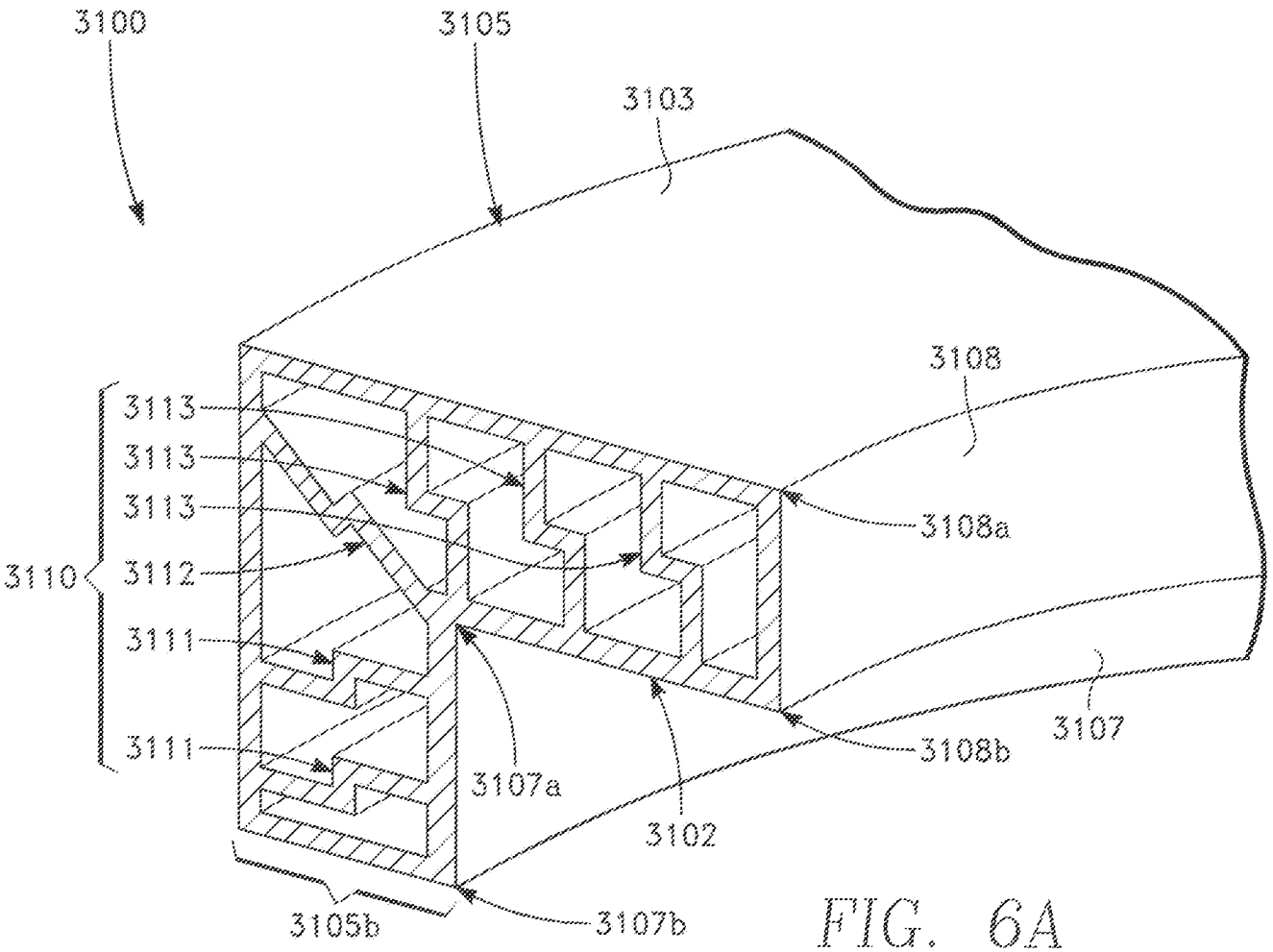
FIGS. 6A and 6B are illustrations of perspective and side elevation, cross section views, respectively, of one embodiment of a portion of the shock resistant fuze cap and shows cripple studs within the circular cap housing.
Figure 6B:
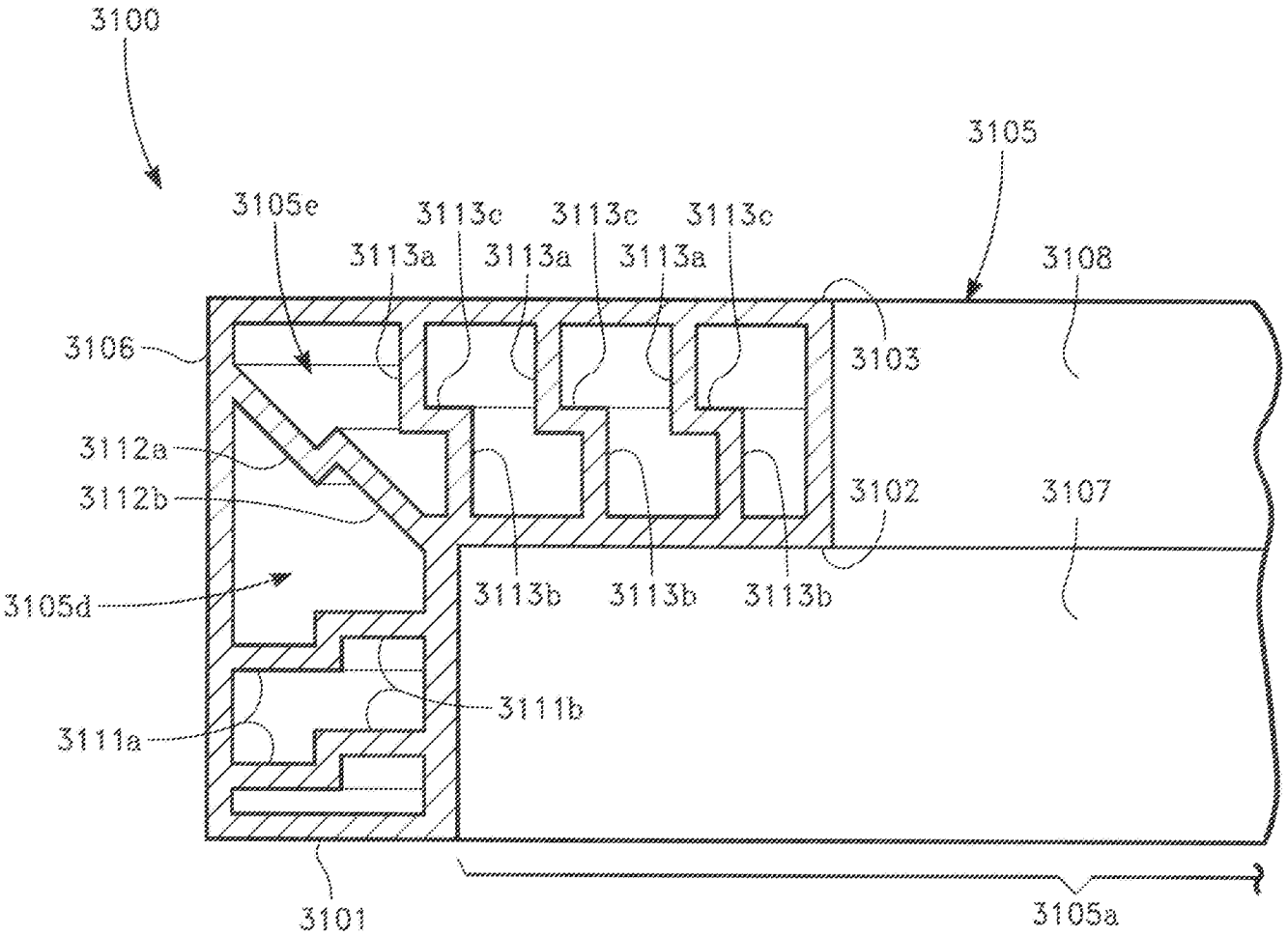

FIGS. 6A and 6B are illustrations of perspective and side elevation, cross section views, respectively, of one embodiment of a portion of the shock resistant fuze cap 3100 and shows cripple studs 3110 within the circular cap housing 3105. As shown in FIGS. 6A and 6B, one embodiment of the shock resistant fuze cap 3100 may comprise a circular cap housing 3105 and cripple studs 3110, which may include: first cripple studs 3111, second cripple studs 3112, and third cripple studs 3113. Additionally, in other embodiments, an insulating liquid compound such as urethane polymer 115 may fill the interior space (i.e., first annular space 3105*d*, second annular space 3105*e*) of the circular cap housing 3105.

As recited above, the center opening 3100*a* of the shock resistant fuze cap 3100 (i.e., center opening 3105*c* of the circular cap housing 3105) is preferably adapted to engage an upper portion 4300 of the fuze 4000. Notably, the circular cap housing 3105 may be configured to house the cripple studs 3110. Like the previous embodiments, the cripple studs 3110 may be semi-rigid, special-purpose structural members that are physically coupled to or integrated with at least two interior, opposing sides of the circular cap housing 3105. The cripple studs 3110 may also be configured to absorb or physically deform when subjected to shock loading energy 120. Notably, the cripple studs 3110 are preferably located within the interior space of the circular cap housing 3105 in order to allow shock loading energy 120 entering from outside the fuze well 3300 to first travel along the cripple studs 3110 prior to contacting the fuze 4000.

FIGS. 6A and 6B show that the cripple studs 3110 of the shock resistant fuze cap 3100 may include first, second, and third cripple studs 3111, 3112, 3113. In particular, the first cripple studs 3111 may be located within the first annular space 3105*d* of the circular cap housing 3105; the second cripple studs 3112 may be located substantially between the first and second annular spaces 3105*d*, 3105*e* within the circular cap housing 3105; and the third cripple studs 3113 may be located within the second annular space 3105*e* of the circular cap housing 3105.

Regarding the first cripple studs 3111 of the shock resistant fuze cap 3100, each first cripple stud 3111 may have at least two web portions 3111*a*, 3111*b* adjoined to each other in an offset pattern, such that each first cripple stud 3111 forms a single step. In particular, the first cripple studs 3111 may comprise a first web portion 3111*a* and second web portion 3111*b*. The first web portion 3111*a* may be located within the first annular space 3105*d* and may have a first end orthogonally adjoining the outer cylindrical sidewall 3106, as shown in FIGS. 6A and 6B. Similarly, the second web portion 3111*b* may be located within the first annular space 3105*d* and may also have a first end orthogonally adjoining the first inner cylindrical sidewall 3107. Importantly, the second ends of the first and second web portions 3111*a*, 3111*b* of the first cripple studs 3111 may adjoin and partially overlap each other, such that the first web portion 3111*a* and second web portion 3111*b* form a single step, as shown in FIGS. 6A and 6B.

Similarly, regarding the second cripple studs 3112, each second cripple stud 3112 may have at least two web portions 3112*a*, 3112*b* adjoined to each other in an offset pattern, such that each second cripple stud 3112 forms a single step. In particular, the second cripple studs 3112 may comprise a first web portion 3112*a* and second web portion 3112*b*. The first web portion 3111*a* may be located substantially between the first and second annular spaces 3105*d*, 3105*e* within the circular cap housing 3105 and may have a first end adjoining the outer cylindrical sidewall 3106, as shown in FIGS. 6A and 6B. Similarly, the second web portion 3112*b* may be located substantially between the first and second annular spaces 3105*d*, 3105*e* within the circular cap housing 3105 and may have a first end adjoining the top end 3107*a* of the first inner cylindrical sidewall 3107 and the outer circumference 3102*b* of the intermediate portion 3102. Importantly, the second ends of the first and second web portions 3112*a*, 3112*b* of the second cripple studs 3112 may adjoin and partially overlap each other, such that the first web portion 3112*a* and second web portion 3112*b* form a single step, as shown in FIGS. 6A and 6B.

Finally, regarding the third cripple studs 3113, each third cripple studs 3113 may have at least three web portions 3113*a*, 3113*b*, 3113*c* adjoined to each other in an offset pattern, such that each third cripple stud 3113 forms a single step. In particular, the third cripple studs 3113 may comprise a first web portion 3113*a*, second web portion 3113*b*, and third web portion 3113*c*. The first web portion 3113*a* may be located within the second annular space 3105*e* of the circular cap housing 3105 and may have a first end orthogonally adjoining the top portion 3103. Similarly, the second web portion 3113*b* may be located within the second annular space 3105*e* within the circular cap housing 3105 and may have a first end orthogonally adjoining the intermediate portion 3102. Finally, the third web portion 3113*c* may extend to and orthogonally adjoin the second ends of the first and second web portions 3113*a*, 3113*b* of the third cripple studs 3113, such that the first web portion 3113*a*, second web portion 3113*b*, and third web portion 3113*c* form a single step, as shown in FIGS. 6A and 6B.

Figure 7A:
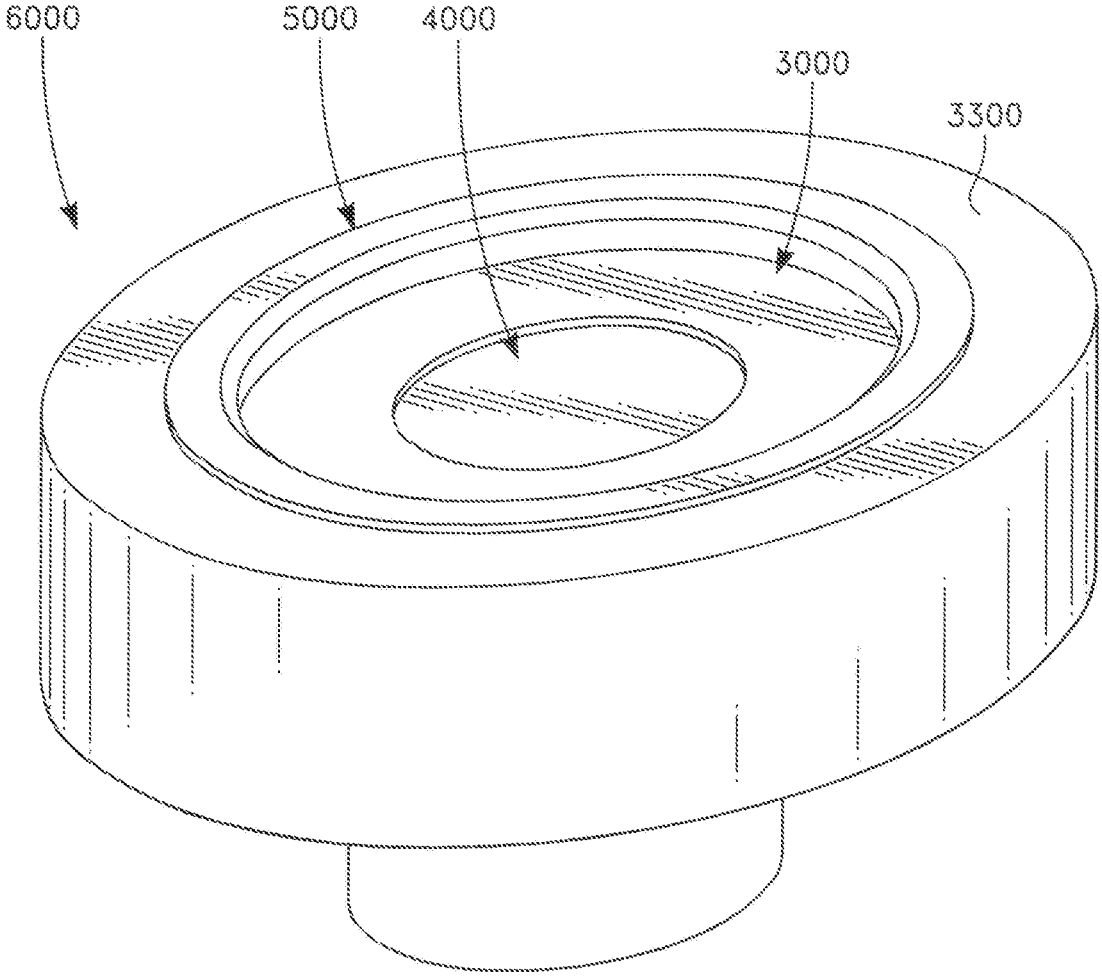
FIGS. 7A and 7B are illustrations of perspective and top plan views, respectively, of a fuze assembly with embodiments of the shock resistant collar and shock resistant fuze cap installed thereon.
Figure 7B:
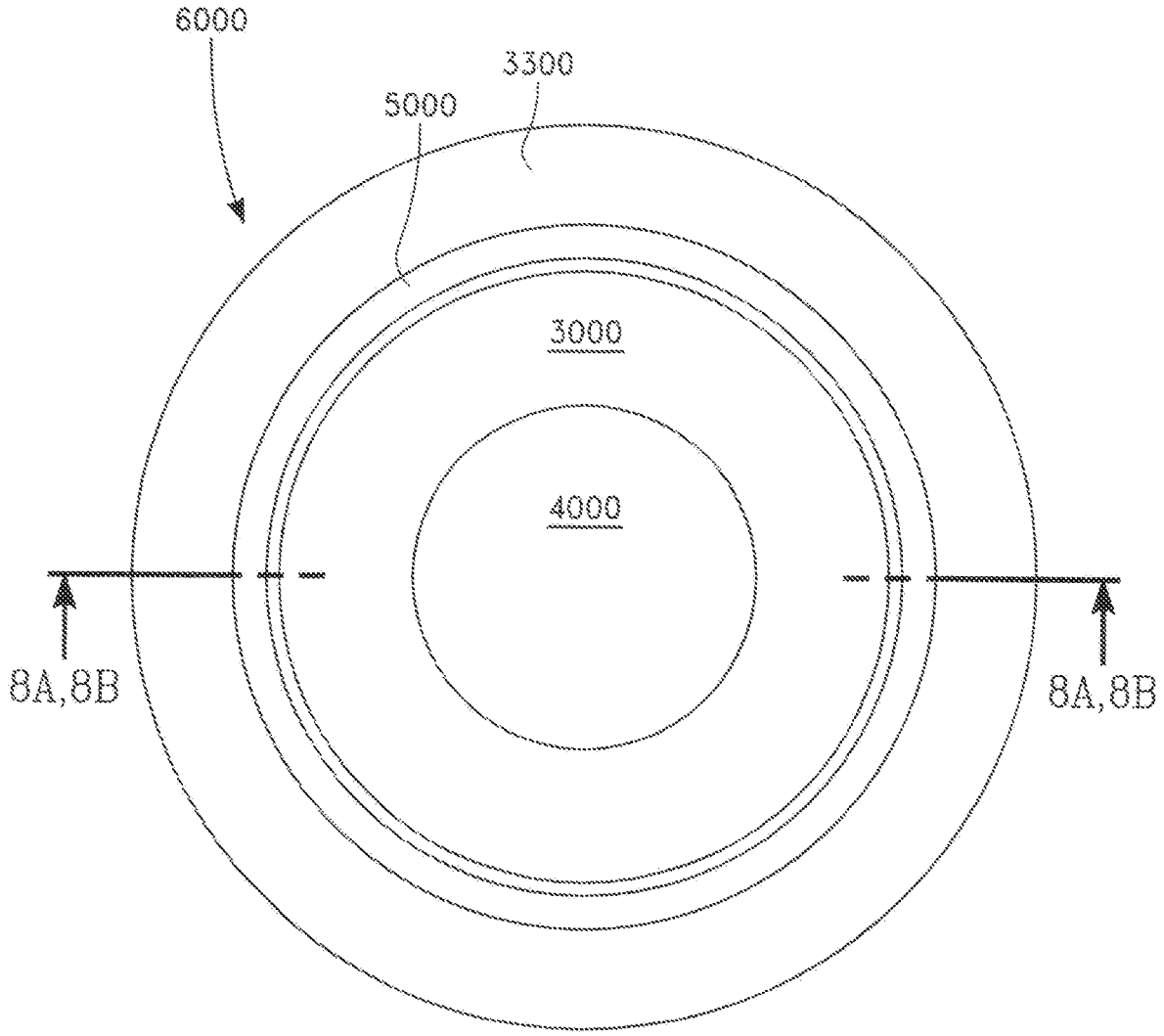

FIGS. 7A and 7B are illustrations of perspective and top plan views, respectively, of a fuze assembly 6000 with embodiments of the shock resistant collar 3200 and shock resistant fuze cap 3100 installed thereon. As shown in FIGS. 7A and 7B, the fuze assembly 6000 may comprise a fuze 4000, fuze well 3300, shock resistant mounting structures (i.e., shock resistant fuze cap and shock resistant collar combination 3000), and retaining ring 5000. Here, additional embodiments of the shock resistant mounting structure may be a shock resistant fuze cap and shock resistant collar combination 3000, comprising a shock resistant fuze cap 3100 and shock resistant collar 3200.

The fuze 4000 may be a device configured to detonate a munition's explosive material under specified conditions and may have safety and arming mechanisms that protect users from premature or accidental detonation. Importantly, the fuze 4000 may contain the electronic or mechanical elements necessary to signal or actuate the detonator and may contain a small amount of primary explosive to initiate the detonation.

The fuze well 3300 may be a physical envelope or casing for interfacing the fuze 4000. Importantly, the fuze well 3300 may be adapted to hold and secure a shock resistant fuze cap 3100, shock resistant collar 3200, and fuze 4000.

FIGS. 8A and 8B are illustrations of perspective and side elevation, cross section views, respectively, of the fuze assembly 6000 with embodiments of the shock resistant collar 3200 and shock resistant fuze cap 3100 installed thereon. FIGS. 8A and 8B show that in order to protect the upper portion 4300 of the fuze 4000 within the fuze well 3300, the center opening 3100*a* of the shock resistant fuze cap 3100 may engage the upper portion 4300 of the fuze 4000, such that the flange end 4100 of the fuze 4000 may fit within the receptacle 3105*a* of the circular cap housing 3105. Importantly, the cripple studs 3110 disposed within the circular cap housing 3105 may be oriented in a direction, traversing towards the fuze 4000. In this manner, shock loading energy 120 may first travel along the cripple studs 3110 prior to advancing towards the fuze 4000.

FIGS. 8A and 8B also show that the shock resistant fuze insert and shock resistant collar combination 3000 may also comprise a shock resistant collar 3200. As discussed above, the shock resistant collar 3200 may have a center opening 3200*a* engaging the fuze body 4200 of the fuze 4000 and may be positioned beneath the flange end 4100 of the fuze 4000 when engaged. Thus, when coupled to the fuze body 4200 while installed within a fuze well 3300, the shock resistant collar 3200 may be disposed between the flange end 4100 of the fuze 4000 and fuze well 3300, as shown in FIGS. 8A and 8B. Notably, the ring-shaped housing 3205 preferably has an outer diameter that is less than the diameter of the receptacle 3105*a* of the circular cap housing 3105. In this manner, the ring-shaped housing 3105 may be adapted to engage the fuze body 4200 and be disposed within the receptacle 3105*a* of the circular cap housing 3105 and fuze well 3300.

Regarding the cripple stud(s) 3210 of the shock resistant collar 3200, the cripple stud(s) 3210 may absorb or deform when subject to shock loading energy 120. The cripple stud(s) 3210 may be radially disposed within the ring-shaped housing 3205, thereby allowing shock loading energy 120 entering from outside the fuze well 3300 to first travel along the cripple stud(s) 3210 prior to contacting the fuze body 4200 of the fuze 4000.

FIGS. 8A and 8B show that when installed, the flange end 4100 of the fuze 4000 is preferably sandwiched or disposed between the shock resistant fuze cap 3100 and the shock resistant collar 3200. In particular, the receptacle 3105*a* of the shock resistant fuze cap 3100 may substantially cover the flanged end 4100 of the fuze when the center opening 3100*a* of the shock resistant fuze cap 3100 engages with the upper portion 4300 of the fuze 4000. The shock resistant collar 3200 may engaged with the fuze body 4200 of the fuze 4000 and may be disposed beneath the flange end 4100 of the fuze 4000 when installed. When engaged within the fuze well 3300, the shock resistant fuze cap and shock resistant collar combination 3000 may further comprise a retaining ring 5000 for holding and securing the shock resistant fuze cap 3100 and shock resistant collar 3200 in place. Specifically, the retaining ring 5000 may snugly fit above the shock resistant fuze cap 3100 and within the fuze well 3300 when the shock resistant fuze cap 3100 and shock resistant collar 3200 are installed.

As recited above, the shock resistant fuze cap 3100 and shock resistant collar 3200 are preferably constructed of a metal. Examples of such metals may include, without limitation, aluminum, titanium alloy, nickel alloy (e.g., Inconel®), and maraging steel. In another embodiment, the shock resistant fuze cap 3100 and shock resistant collar 3200 may be cast or additively manufactured. Additionally, the shock resistant fuze cap 3100 and/or shock resistant collar 3200 may be filled with an insulating compound such as a urethane polymer.

Figure 9A:
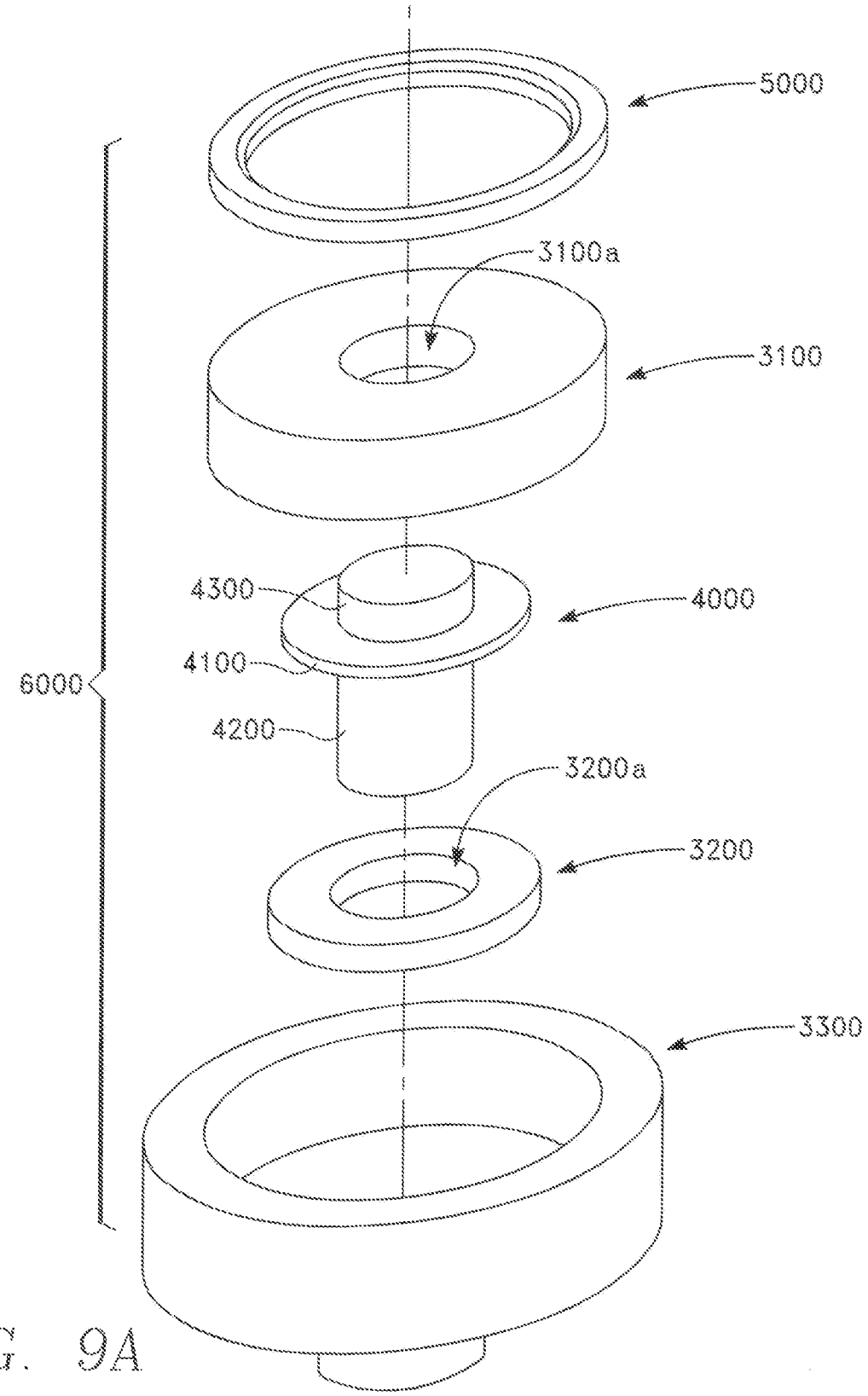
FIGS. 9A and 9B are illustrations of perspective and side elevation, exploded views, respectively, of the fuze assembly.
Figure 9B:
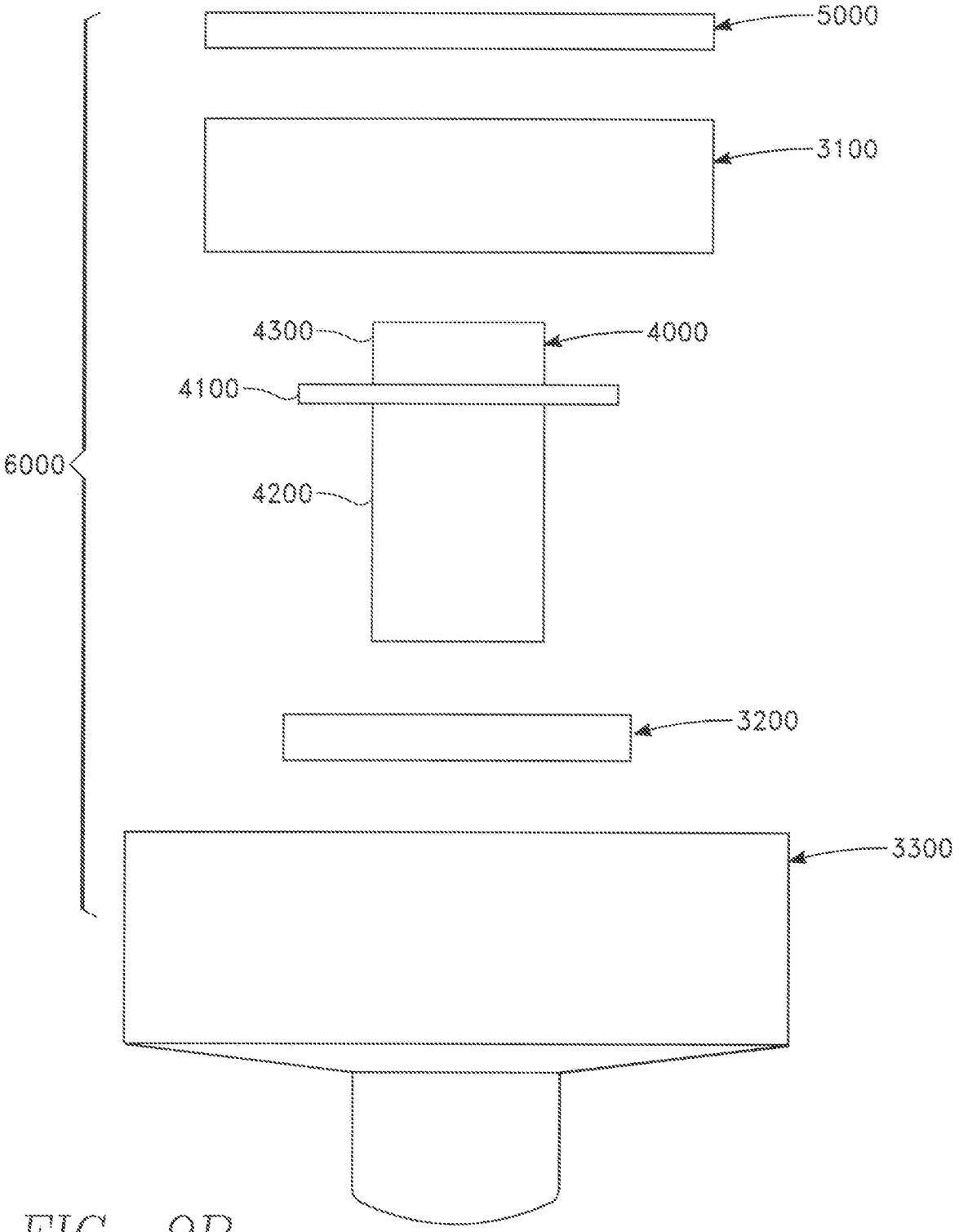

FIGS. 9A and 9B are illustrations of perspective and side elevation, exploded views, respectively, of the fuze assembly 6000. As shown in FIGS. 9A and 9B, one embodiment of the fuze assembly 6000 may comprise a fuze 4000, fuze well 3300, retaining ring 5000, and shock resistant mounting structures, which may be a shock resistant fuze cap and shock resistant collar combination 3000, comprising a shock resistant fuze cap 3100 and shock resistant collar 3200.

Figure 10A:
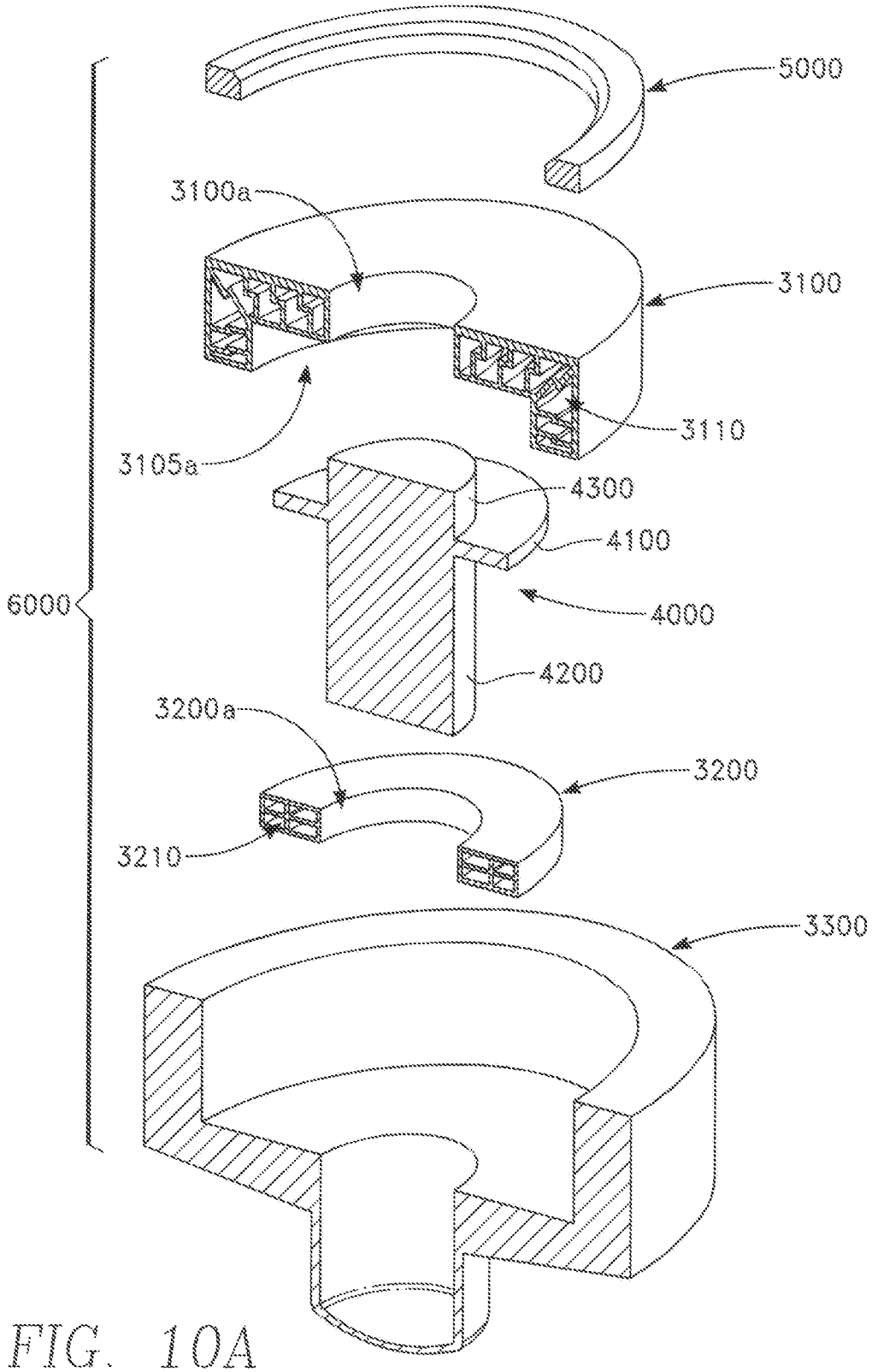
FIGS. 10A and 10B are illustrations of perspective and side elevation, exploded cross section views, respectively, of the fuze assembly.
Figure 10B:
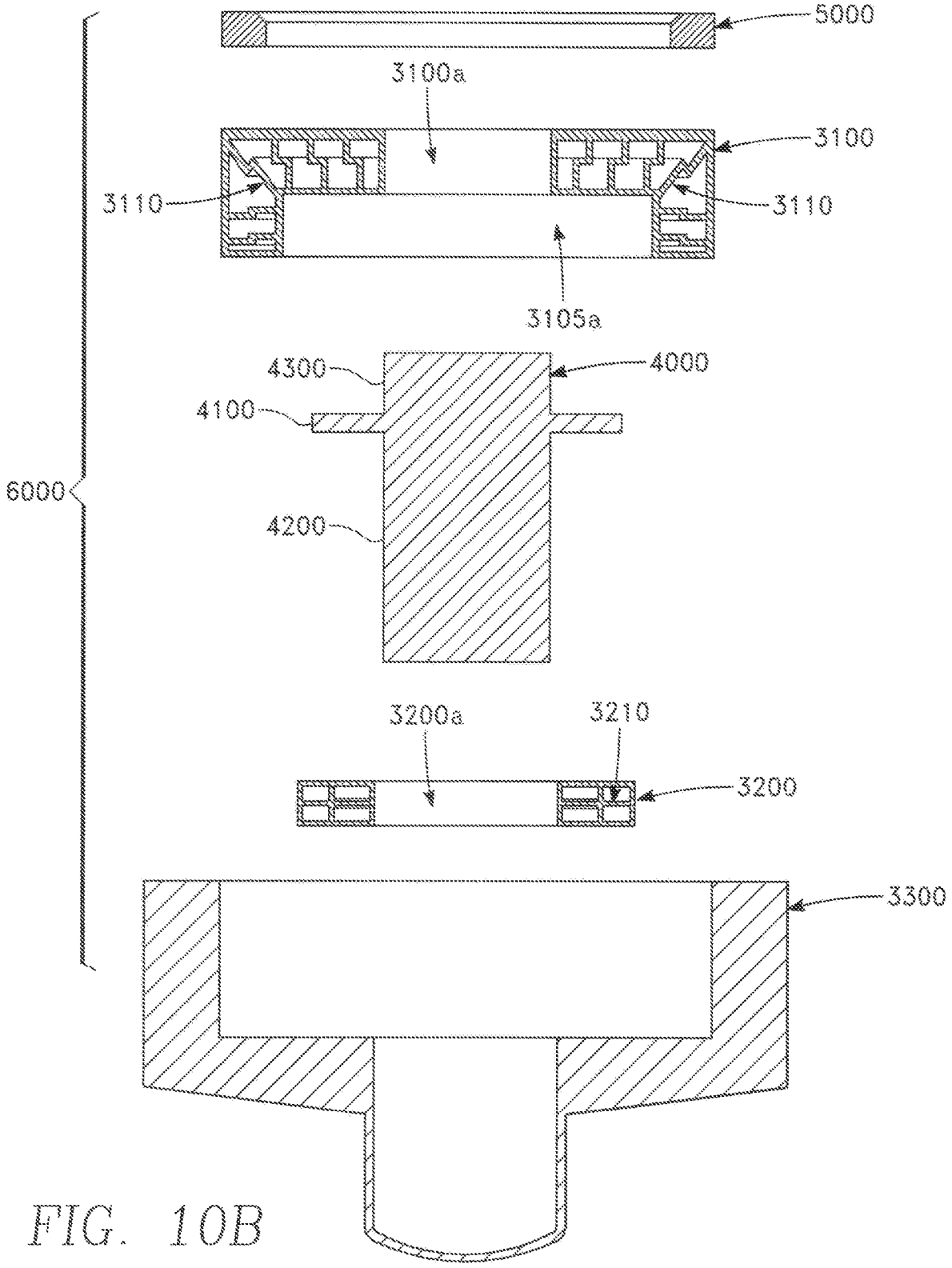

FIGS. 10A and 10B are illustrations of perspective and side elevation, exploded cross section views, respectively, of the fuze assembly 6000. As shown in FIGS. 10A and 10B, one embodiment of the fuze assembly 6000 may comprise a fuze 4000, fuze well 3300, retaining ring 5000, shock resistant fuze cap 3100, and shock resistant collar 3200.

Importantly, FIGS. 10A and 10B also show the cripple studs 3110, 3210 disposed within the shock resistant fuze cap 3100 and shock resistant collar 3200. Specifically, the shock resistant fuze cap 3100 may comprise a first set of cripple studs 3111, second set of cripple studs 3112, and third set of cripple studs 3113, as shown above in FIGS. 6A to 6B. The shock resistant collar 3200 may likewise comprise one or more cripple studs 3210.

As discussed above, each cripple stud 3111, 3112, 3113, 3210 may have web portions 3111*a*, 3111*b*, 3112*a*, 3112*b*, 3113*a*, 3113*b*, 3113*c* having various shapes. In particular, within the circular cap housing 3105 of the shock resistant fuze cap 3100, the first set of cripple studs 3111 and second set of cripple studs 3112 may have at least two web portions 3111*a*, 3111*b*, 3112*a*, 3112*b*, such that each cripple stud 3111, 3112 may form a single step. Similarly, the third set of cripple studs 3113 may have three web portions 3113*a*, 3113*b*, 3113*c*, also forming a single step. Regarding the shock resistant collar 3200, each cripple stud 3210 may have a least two web portions 3210*a*, 32106 extending between two opposing inner sides of the ring-shaped housing 3205 and intersecting each other at a midsection, such that each cripple stud 3210 may be substantially shaped as a cross. While FIGS. 10A and 10B show cripple studs resembling a single step or cross, other embodiments of the cripple studs may have various shapes.

The foregoing description of the embodiments of the shock resistant mounting structures for fuze systems has been presented for the purposes of illustration and description. While multiple embodiments of the shock resistant mounting structures are disclosed such as the shock resistant fuze cap and shock resistant collar, other embodiments will become apparent to those skilled in the art from the above detailed description. As will be realized, these embodiments are capable of modifications in various obvious aspects, all without departing from the spirit and scope of the present disclosure. Accordingly, the detailed description is to be regarded as illustrative in nature and not restrictive.

Although embodiments of the shock resistant mounting structure are described in considerable detail, other versions are possible such as, for example, orienting and/or attaching the shock resistant fuze cap and/or shock resistant collar in a different fashion. Therefore, the spirit and scope of the appended claims should not be limited to the description of versions included herein.

Except as stated immediately above, nothing, which has been stated or illustrated, is intended or should be interpreted to cause a dedication of any component, step, feature, object, benefit, advantage, or equivalent to the public, regardless of whether it is or is not recited in the claims. The scope of protection is limited solely by the claims that now follow, and that scope is intended to be broad as is reasonably consistent with the language that is used in the claims. The scope of protection is also intended to be broad to encompass all structural and functional equivalents.

What is claimed as new and desired to be protected by Letters Patent is set forth in the appended claims:

1. A shock resistant collar, comprising:

a ring-shaped housing having an annular space defined by:

an outer cylindrical sidewall;

an inner cylindrical sidewall concentrically disposed within said outer cylindrical sidewall and defining a center opening of said ring-shaped housing, said center opening being adapted to snugly insert a fuze body of a fuze;

a bottom portion, generally ring-shaped, and having an inner circumference adjoining a bottom end of said inner cylindrical sidewall and an outer circumference adjoining a bottom end of said outer cylindrical sidewall; and a top portion, generally ring-shaped, and having an inner circumference adjoining a top end of said first inner cylindrical sidewall and an outer circumference adjoining a top end of said outer cylindrical sidewall; and one or more cripple studs located within said annular space of said ring-shaped housing and radially disposed around said inner cylindrical sidewall, wherein each of said one or more cripple studs comprises:

a vertical web portion having a bottom end orthogonally adjoining said bottom portion and a top end orthogonally adjoining said top portion; and a horizontal web portion having a first end orthogonally adjoining said inner cylindrical sidewall and a second end orthogonally adjoining said outer cylindrical sidewall;

wherein mid-sections of said vertical web portion and said horizontal web portion adjoin together, such that each of said one or more cripple studs are substantially cross-shaped.

2. The shock resistant collar according to claim 1, wherein said ring-shaped housing and said one or more cripple studs are constructed of a metal; and wherein said vertical web portions and said horizontal web portions of said one or more cripple studs have a maximum thickness of 0.25 inches, such that said vertical web portions and said horizontal web portions are semi-rigid.

3. The shock resistant collar according to claim 1, wherein said ring-shaped housing is filled with a urethane polymer.

4. The shock resistant collar according to claim 1, wherein said one or more cripple studs are oriented in spaced parallel relation to each other.

5. The shock resistant collar, according to claim 1, wherein said ring-shaped housing and said one or more cripple studs form a single unitary piece.

6. The shock resistant collar according to claim 1, wherein said ring-shaped housing is generally circular.

7. A shock resistant fuze cap, comprising:

a circular cap housing defined by:

an outer cylindrical sidewall adapted to snugly fit within a fuzewell;

a first inner cylindrical sidewall concentrically disposed within a bottom end of said outer cylindrical sidewall;

a bottom portion, generally ring-shaped, and having an inner circumference adjoining a bottom end of said first inner cylindrical sidewall and an outer circumference adjoining said bottom end of said outer cylindrical sidewall, thereby forming a first annular space therein;

a second inner cylindrical sidewall having a diameter less than said first inner cylindrical sidewall and concentrically disposed within a top end of said outer cylindrical sidewall, wherein said second inner cylindrical sidewall defines a center opening of said circular cap housing and is adapted to snugly engage an upper portion of a fuze;

an intermediate portion, generally disc-shaped, and having an inner circumference adjoining a bottom end of said second inner cylindrical sidewall and an outer circumference adjoining a top end of said first inner cylindrical sidewall; and a top portion, generally disc-shaped, and having an outer circumference adjoining said top end of said outer cylindrical sidewall and an inner circumference adjoining a top end of said second inner cylindrical sidewall, such that said top portion, said second inner cylindrical sidewall, and said intermediate portion form a second annular space therein;

wherein said first inner cylindrical sidewall and said intermediate portion form a receptacle configured to fit a flange end of a fuze, such that said circular cap housing is adapted to be disposed between said flange end of said fuze and a fuze well; and wherein said circular cap housing includes an interior space defined by said first and second annular spaces; and a plurality of cripple studs disposed within said interior space of said circular cap housing and including:

one or more first cripple studs, each comprising:

a first web portion located within said first annular space and having a first end orthogonally adjoining said outer cylindrical sidewall; and a second web portion located with said first annular space and having a first end orthogonally adjoining said first inner cylindrical sidewall;

wherein second ends of said first and second web portions of said one or more first cripple studs adjoin and partially overlap each other to form one or more first single steps;

one or more second cripple studs, each comprising:

a first web portion disposed substantially between said first and second annular spaces and having a first end adjoining said outer cylindrical sidewall; and a second web portion located substantially between said first and second annular spaces and having a first end adjoining said top end of said first inner cylindrical sidewall and said outer circumference of said intermediate portion;

wherein second ends of said first and second web portions of said one or more second cripple studs adjoin and partially overlap each other to form one or more second single steps; and one or more third cripple studs, each comprising:

a first web portion located within said second annular space and having a first end orthogonally adjoining said top portion;

a second web portion located within said second annular space and having a first end orthogonally adjoining said intermediate portion; and a third web portion extending to and orthogonally adjoining second ends of said first and second web portions of said one or more third cripple studs to form one or more third single steps.

8. The shock resistant fuze cap according to claim 7, wherein said circular cap housing and said plurality of cripple studs are constructed of a metal; and wherein said first, second, and third web portions of said plurality of cripple studs have a maximum thickness of 0.25 inches, such that said plurality of cripple studs are semi-rigid.

9. The shock resistant fuze cap according to claim 7, wherein said circular cap housing is filled with a urethane polymer.

10. The shock resistant fuze cap according to claim 7, wherein said circular cap housing and said plurality of cripple studs form a single unitary piece.

11. A shock resistant fuze cap and collar combination, comprising:

a circular cap housing defined by:

a first outer cylindrical sidewall adapted to snugly fit within a fuzewell;

a first inner cylindrical sidewall concentrically disposed within a bottom end of said first outer cylindrical sidewall;

a first bottom portion, generally ring-shaped, and having an inner circumference adjoining a bottom end of said first inner cylindrical sidewall and an outer circumference adjoining said bottom end of said first outer cylindrical sidewall, thereby forming a first annular space therein;

a second inner cylindrical sidewall having a diameter less than said first inner cylindrical sidewall and concentrically disposed within a top end of said first outer cylindrical sidewall, wherein said second inner cylindrical sidewall defines a center opening of said circular cap housing and is adapted to snugly engage an upper portion of a fuze;

an intermediate portion, generally disc-shaped, and having an inner circumference adjoining a bottom end of said second inner cylindrical sidewall and an outer circumference adjoining a top end of said first inner cylindrical sidewall; and a first top portion, generally disc-shaped, and having an outer circumference adjoining said top end of said outer cylindrical sidewall and an inner circumference adjoining a top end of said second inner cylindrical sidewall, such that said first top portion, said second inner cylindrical sidewall, and said intermediate portion form a second annular space therein;

wherein said first inner cylindrical sidewall and said intermediate portion form a receptacle configured to fit a flange end of a fuze, such that said circular cap housing is adapted to be disposed between said flange end of said fuze and a fuze well; and wherein said circular cap housing includes an interior space defined by said first annular space and said second annular space; and a plurality of cripple studs disposed within said interior space of said circular cap housing and including:

one or more first cripple studs, each comprising:

a first web portion located within said first annular space and having a first end orthogonally adjoining said first outer cylindrical sidewall; and a second web portion located with said first annular space and having a first end orthogonally adjoining said first inner cylindrical sidewall;

wherein second ends of said first and second web portions of said one or more first cripple studs adjoin and partially overlap each other to form one or more first single steps;

one or more second cripple studs, each comprising:

a first web portion located substantially between said first and second annular spaces and having a first end adjoining said first outer cylindrical sidewall; and a second web portion located substantially between said first and second annular spaces and having a first end adjoining said top end of said first inner cylindrical sidewall and said outer circumference of said intermediate portion;

wherein second ends of said first web portions and said second web portions of said one or more second cripple studs adjoin and partially overlap each other to form one or more second single steps; and one or more third cripple studs, each comprising:

a first web portion located within said second annular space and having a first end orthogonally adjoining said first top portion;

a second web portion located within said second annular space and having a first end orthogonally adjoining said intermediate portion; and a third web portion extending to and orthogonally adjoining second ends of said first and second web portions of said one or more third cripple studs to form a one or more third single steps; and a shock resistant collar, comprising:

a ring-shaped housing having a third annular space defined by:

a second outer cylindrical sidewall;

a third inner cylindrical sidewall concentrically disposed within said second outer cylindrical sidewall and defining a center opening of said ring-shaped housing, said center opening being adapted to snugly insert a fuze body of a fuze;

a second bottom portion, generally ring-shaped, and having an inner circumference adjoining a bottom end of said third inner cylindrical sidewall and an outer circumference adjoining a bottom end of said second outer cylindrical sidewall; and a second top portion, generally ring-shaped, and having an inner circumference adjoining atop end of said third inner cylindrical sidewall and an outer circumference adjoining a top end of said second outer cylindrical sidewall; and one or more fourth cripple studs located within said third annular space of said ring-shaped housing and radially disposed around said third inner cylindrical sidewall, wherein each of said one or more fourth cripple studs comprises:

a vertical web portion having a bottom end orthogonally adjoining said second bottom portion and at top end orthogonally adjoining said second top portion; and a horizontal web portion having a first end orthogonally adjoining said third inner cylindrical sidewall and a second end orthogonally adjoining said second outer cylindrical sidewall;

wherein mid-sections of said vertical web portion and said horizontal web portion orthogonally adjoin together, such that each of said one or more fourth cripple studs are substantially cross-shaped;

wherein said ring-shaped housing has a center opening adapted to snugly insert a fuze body of said fuze; and wherein said ring-shaped housing has an outer diameter less than a diameter of said receptacle of said circular cap housing, such that when said fuze body is snugly fit within said center opening of said ring-shaped housing, said ring-shaped housing is adapted to fit within said receptacle of said circular cap housing, said fuze well, and said flange end of said fuze.

12. The shock resistant fuze cap and collar combination, according to claim 11, wherein said ring-shaped housing, said circular cap housing, and said one or more first, second, third, and fourth cripple studs are constructed of a metal; and wherein said first, second, and third web portions of said one or more first, second, and third cripple studs and said vertical and horizontal web portions of said one or more fourth cripple studs have a maximum thickness of 0.25 inches, such that said one or more first, second, third, and fourth cripple studs are semi-rigid.

13. The shock resistant fuze cap and collar combination, according to claim 11, wherein said circular cap housing is filled with a urethane polymer.

14. The shock resistant fuze cap and collar combination, according to claim 11, wherein said ring-shaped housing is filled with a urethane polymer.

15. The shock resistant fuze cap and collar combination, according to claim 11, wherein said one or more fourth cripple studs are oriented in spaced parallel relation to each other.

16. The shock resistant fuze cap and collar combination, according to claim 11, wherein said circular cap housing and said one or more first, second, and third cripple studs form a single unitary piece.

17. The shock resistant fuze cap and collar combination, according to claim 11, wherein said ring-shaped housing and said one or more fourth cripple studs form a single unitary piece.

18. The shock resistant fuze cap and collar combination, according to claim 11, wherein said ring-shaped housing is generally circular.

19. The shock resistant fuze cap and collar combination, according to claim 11, further comprising a retaining ring adapted to fit within said fuze well when said shock resistant fuze cap, said shock resistant collar, and said fuze are installed within said fuze well.

20. The shock resistant fuze cap and collar combination, according to claim 11, wherein said flange end of said fuze is disposed between said shock resistant fuze cap and said shock resistant collar when said shock resistant collar and said shock resistant fuze cap are engaged with said flange end of said fuze and installed within said fuze well.

* * * * *